United States Patent [19]

Hixson et al.

[11] 4,069,118

[45] Jan. 17, 1978

[54] ELECTROLYSIS CONTROL APPARATUS AND METHOD

[75] Inventors: Elmer L. Hixson; Carl M. Talkington, both of Austin, Tex.

[73] Assignee: Stauffer Chemical Company, Richmond, Calif.

[21] Appl. No.: 630,099

[22] Filed: Nov. 10, 1975

[51] Int. Cl.[2] ..... C25B 1/16; C25B 1/26; C25B 15/06

[52] U.S. Cl. ..... 204/99; 204/128; 204/225; 204/228; 324/51; 340/253 Y

[58] Field of Search ..... 204/225, 99, 128, 228, 204/1 R; 340/253 Y; 324/51

[56] References Cited

U.S. PATENT DOCUMENTS

| | | | |
|---|---|---|---|
| 2,933,440 | 4/1960 | Greenfield | 204/67 |
| 3,241,064 | 3/1966 | Bartels et al. | 324/77 E |
| 3,396,095 | 8/1968 | Van Diest et al. | 204/225 |
| 3,531,392 | 9/1970 | Schmeiser | 204/225 |
| 3,627,666 | 12/1971 | Bonfils | 204/225 |
| 3,689,398 | 9/1972 | Caleffi | 204/220 |
| 3,763,024 | 10/1973 | Englemann et al. | 204/1 R |
| 3,790,457 | 2/1974 | Quietzch et al. | 204/99 |
| 3,808,487 | 4/1974 | Feuillade | 324/29.5 X |
| 3,844,913 | 10/1974 | Warren | 204/99 |
| 3,849,268 | 11/1974 | Miyamaoto et al. | 204/99 |
| 3,853,723 | 12/1974 | Mack | 204/99 |
| 3,926,750 | 12/1975 | Adachi et al. | 204/99 |

FOREIGN PATENT DOCUMENTS

| | | | |
|---|---|---|---|
| 23,120 | 6/1974 | Japan | 204/225 |
| 1,167,001 | 10/1969 | United Kingdom | 204/225 |

*Primary Examiner*—G. L. Kaplan
*Attorney, Agent, or Firm*—Flehr, Hohbach, Test, Albritton & Herbert

[57] ABSTRACT

A method and apparatus for controlling an electrolysis reaction of the type used to produce chlorine gas and sodium hydroxide. Bus voltage and bus current are detected and utilized in connection with a plurality of control parameters. Oscillations in bus current are detected as one control parameter which is a precursor to shorts. The anode/cathode spacing is adjusted in response to the control parameters to avoid or reduce the frequency of shorts, minimize power consumption, and otherwise improve the efficiency of operation.

39 Claims, 10 Drawing Figures

ELECTROLYSIS CONTROL APPARATUS AND METHOD

BACKGROUND OF THE INVENTION

The present invention relates to the field of electrolysis and specifically to controlling an electrolysis process to minimize power consumption without causing shorts through adjustment of anode/cathode spacing.

Many electrolysis processes are well-known and are employed, for example, in the production of sodium hydroxide, chlorine, potassium hydroxide, sodium sulfide and sodium hydrosulfite.

An electrolytic cell for the production of chlorine gas, for example, employs an anode immersed in a salt brine and positioned above a cathode formed by a thin layer of mercury on the cell bed. When current is passed through the cell, chlorine gas and sodium amalgam are produced, with hydrogen formation a competing reaction. The reaction for chlorine formation is given by the following expression:

$$NaCl + (Hg) \xrightarrow{1\ \text{Faraday}} Na(Hg) + \tfrac{1}{2}\, Cl_2(g) \qquad \text{Eq. (1)}$$

For the usual range of temperatures, concentrations, and pressure, the reversible equilibrium potential ($E_r$) for the reaction of Eq. (1) is $-3.05$ volts. Actual cell voltage drops are greater than $E_r$ because of cathode and anode polarization, and ohmic drop through the brine layer, and in electrical conductors and contacts.

The value of $E_r$ for the competing hydrogen reaction is lower than for the chlorine reaction, but high overvoltages kinetically limit hydrogen production rates during normal cell operation. Reduction of hydrogen overvoltage can result in a rapid increase in hydrogen concentrations in the chlorine gas and explosion hazards. Hydrogen overvoltage reduction will result from any of a number of causes, such as impurities in the brine or mercury, locally high current densities caused by poor current distribution, or by short circuiting between the cell anode and mercury cathode, across the brine gap (a "cell short," or "shorting").

With the electrolysis reaction proceeding in accordance with Eq. (1) the sodium-mercury amalgam formed is caused to flow to a decomposer where it is combined with water to produce sodium hydroxide, NaOH, as indicated by the following expression:

$$Na(Hg) + H_2O \rightarrow NaOH + \tfrac{1}{2}\, H_2 + (Hg) \qquad \text{Eq. (2)}$$

The power consumed in carrying out the electrolysis reaction of Eq. (1) is a product of the cell potential, Ec, which is the potential drop across the cell and the cell current, Ic, which is the current through the cell. In order to employ the minimum power, the cell potential, Ec, is reduced to the smallest value which will maintain the electrolysis reaction of Eq. (1) without shorting or permitting the competing hydrogen reaction to predominate.

The component potentials which are summed to form the cell potential, Ec, are: the reversible potential, the ohmic potential due to the potential drop across the electrolyte, contact potential due to the potential drop at the bus joints, the bus potential due to the potential drop along the cell conductors, and the polarization voltages due to the polarization at each of the two electrodes. Over the normal range of cell operation conditions, polarization and ohmic voltage drops can be represented as the sum of constant terms plus terms dependent on temperature ($\tau$) and cell current (Ic). The reversible potential, plus the constant portions of the polarization and ohmic potentials can be represented by the constant Eo.

For convenience, the current-dependent terms of the contact and bus potential drop can be combined as a temperature-varying resistance ($R\tau$) multiplied by the cell current (Ic), to yield ($R\tau$) (Ic).

The current-dependent terms of the brine potential drop can be expressed as the product of a temperature-dependent brine resistance term ($\rho\tau$) and the ratio of the brine gap (S) to the anode area (A) to yield (Ic) ($\rho\tau$) (S/A).

With these definitions, the cell potential is given by the following expression:

$$Ec = Eo + [Ic][R\tau] + [IC][\rho\tau][(S/A)] \qquad \text{Eq. (3)}$$

In order to minimize the cell potential, Ec, the potential drop across the electrolyte, [Ic][($\rho\tau$) (S/A)] is reduced by reducing the anode/cathode spacing, S.

Although it has long been known to be desirable to reduce the anode/cathode spacing to reduce power consumption, such a reduction can increase the hazards of cell shorts. These are undesirable in that they often require stopping and restarting of the electrolysis reaction, in that they cause damage to the anodes, and in that they are accompanied by undesirable alternative and dangerous hydrogen generation which reduces current efficiency and may result in explosions and cell damage.

In order to regulate an electrolysis reaction by adjusting anode/cathode spacing, others have previously suggested moving the anode momentarily into contact with the cathode. Such anode/cathode contact, besides resulting in a short circuit, theoretically is supposed to identify a reference position where a short will occur. After the harmful short is detected, the anode is retracted a predetermined amount from that reference position. In actual practice, of course, the objective is to avoid shorts and therefore "reference positions" are established by operators who known, through experience, the location of the reference positions which do not cause shorts. Notwithstanding suggestions in the prior art, it is not believed practical or desirable to actually induce short circuits for control purposes. This conclusion is believed true even though attempts have been made to detect shorts rapidly and, after detection, to retract the anode before substantial damage has occurred. Such attempts even when retraction is accomplished during early stages of an anode/cathode short, have not proved entirely satisfactory nor reliably stable.

Prior attempts at reducing the frequency of shorts have also monitored various electrical signals such as changes in anode/cathode voltage or current, to detect short-causing conditions. In one example, short-causing transients, like those output from a poorly regulated power supply, have been monitored. Such transients can be characterized as current "spikes" which are generally not oscillatory and which have a very high frequency spectrum when observed by Fourier analysis. While such monitors may be useful where poor power supply regulation exists, they have not heretofore been satisfactory for reducing shorts where good power supply regulation is present.

While other attempts at regulating anode/cathode spacing have also been tried, heretofore, no reliable or completely satisfactory indicators of shorts have been available in the absence of actually causing or detecting the actual undesirable shorts.

In accordance with the above background, it is the objective of the present invention to provide a method and apparatus, capable of use in production facilities, for controlling electrolysis reactions with reduced power consumption and with less damage from actual anode/cathode shorts.

SUMMARY OF THE INVENTION

The present invention is a method and apparatus for controlling and monitoring an electrolysis reaction so as to reduce or avoid anode/cathode shorts while minimizing power consumption, through minimizing anode/cathode spacing. A plurality of control parameters are utilized in the controlling and monitoring functions. One control parameter is current, which is analyzed to detect current oscillations which are precursors of shorts. When current oscillations are detected, the anode/cathode spacing is increased until stable current is regained.

Other parameters are excursions of current and voltage above or below predetermined upper and lower limits.

In an embodiment where a plurality of cells are connected in an array, apparatus is provided for periodically polling the cells to obtain control parameters and monitor the operation of all cells in the array. Where each cell includes a plurality of buses in each cell, apparatus is also provided for polling each bus within a cell.

In one specific embodiment of the invention, the array of electrolysis cells includes sixteen parallel buses with 52 cells serially connected along each bus with sixteen anode units per cell. Each anode unit may typically include three anodes. Each one of the 16 anode units in a cell connects to a cell instrumentation package where there are 52 cell instrumentation packages. Each of the instrumentation packages includes detectors for detecting the bus current, $Ib$, for each bus in a cell, the bus potential, $Eb$, from each bus to the cathode of each cell and the temperature associated with the cell. In each instrumentation package, the detected signals are selected one at a time by a multiplexer for input to an analog-to-digital converter which provides converted signals. The converted signals are transmitted to a computer where they are analyzed to determine the control parameters utilized to control and monitor the electrolysis reaction.

The control parameters include current oscillations, variations in current above or below upper and lower limits, variations in voltage above or below upper and lower limits, and variations of a particular bus current above or below the average current of multiple bus currents. Of particular interest for identifying shorts is the detection of a current above an upper limit simultaneously with a voltage below a lower limit for the same anode unit. For a typical system, current oscillations having a frequency of less than approximately one cycle per second are detected.

The current oscillations are detected in accordance with the following method. A change in current, $\Delta Ib$, is periodically obtained for each increment of time, $\Delta t$. The increment $\Delta t$ is typically the polling interval established by the polling apparatus. The $\Delta Ib$ determination for each increment $\Delta t$ is compared with a predetermined constant, $\epsilon$. Depending on the absolute value of $\Delta Ib$, an accumulated measurement signal $Xb$, is incremented or decremented thereby performing a running integration of $\Delta Ib/\Delta t$ If the magnitude of $Xb$ exceeds a predetermined constant, that condition signifies that current oscillations have been detected. Other control parameters are detected by additional methods.

In accordance with the above summary, the present invention achieves the objective of providing an improved method and apparatus for the control and monitoring of electrolysis reactions.

DETAILED DESCRIPTION

Figure 1:
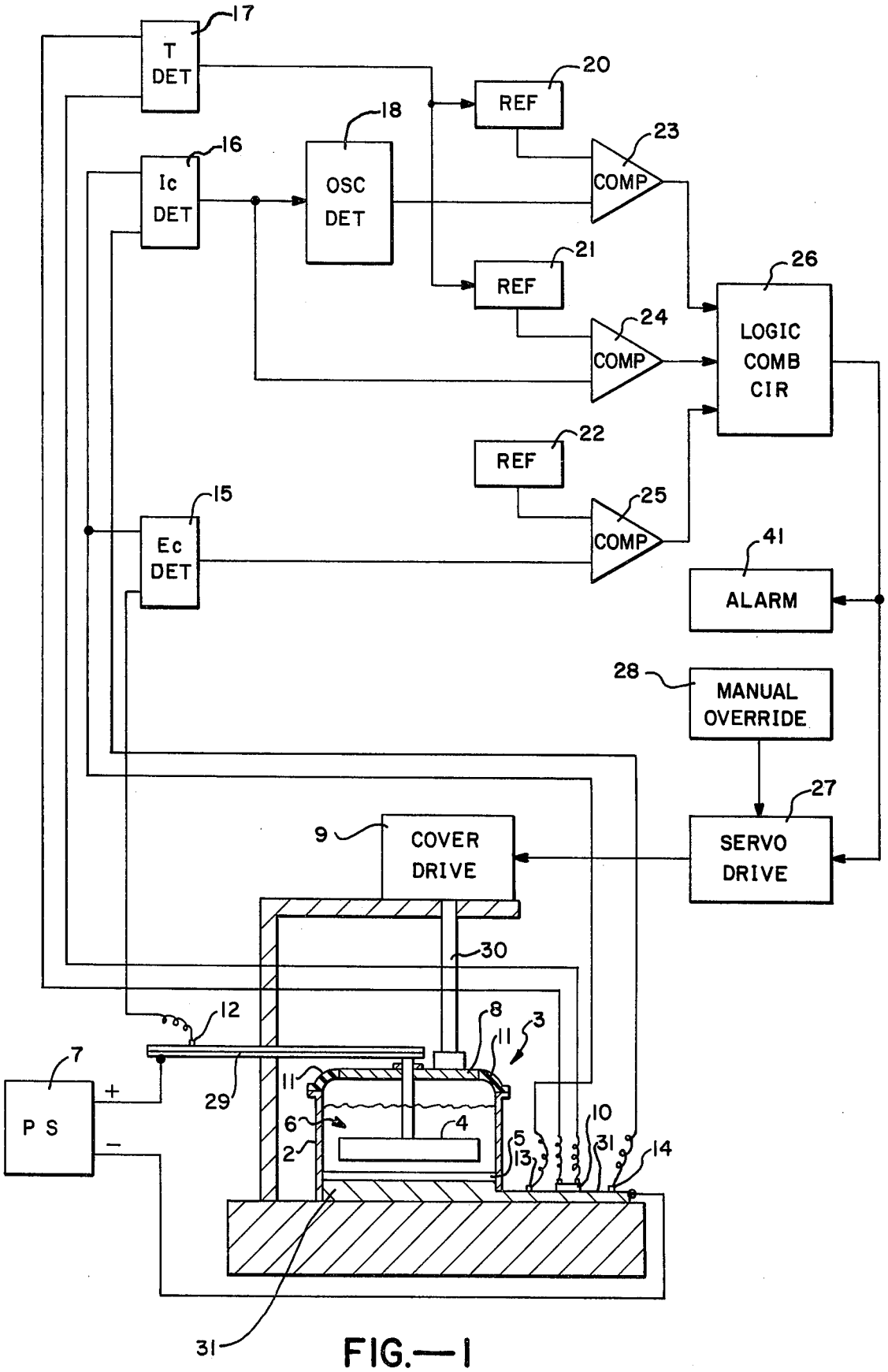
FIG. 1 depicts a schematic representation of a control apparatus connected to an electrolysis cell in accordance with the present invention.

In FIG. 1, the apparatus is responsive to a plurality of control parameters for controlling and monitoring an electrolysis cell 3. The electrolysis cell 3 includes an anode 4, a mercury cathode 5 surrounded by cell walls 2. The cell is covered by a cover 8 with a flexible seal 11 to form a tight compartment. Within the compartment the anode 4 is immersed in an electrolyte solution 6. For electrolysis to form chlorine, the solution is salt brine, NaC1. A cover drive 9 is rigidly attached to the cover 8 by a drive shaft 30. Drive 9 functions to raise or lower the cover 8 and thereby raise or lower the anode 4 relative to the mercury cathode 5.

Current is supplied to the cell 3 by a power supply 7. The positive output from supply 7 connects along the anode bus 29 and conducts current through anode 4 and electrolyte 6 to the mercury cathode 5. The cathode 5 is in electrical contact with a cathode bus 31 which connects to the negative return path of a power supply 7. The anode bus 29 has a terminal 12 and the cathode bus 31 has a terminal 13 for measuring the cell anode/cathode potential, Ec. Terminal 13 and a second cathode terminal 14 are provided for detecting cell bus current, Ic. The terminals 13 and 14 are displaced a predetermined distance, for example 0.45 meters, upon the conductor 31. Conductor 31 is a high conductivity metal (e.g. copper). The temperature of the bus 31 is measured by a temperature transducer 10.

In FIG. 1, the cell potential, Ec, is detected by a voltage detector 15 connected to receive the signal between terminals 12 and 13. The cell current, Ic, is detected by a voltage detector 16 connected to receive the signal between the terminals 13 and 14. The temperature of the cell is detected by a voltage detector 17 connected to detect the signal from the temperature transducer 10. The detectors 15, 16 and 17 are conventional differential amplifiers or other circuits which produce outputs which are functions of the input voltages. The input voltage to detector 16, as measured between fixed terminals along the bus 31, is directly proportional to the current in the cell 3.

The output from detector 15, proportional to the cell potential, is input to the comparator 35. Comparator 25 compares the signal from detector 15 with a predetermined reference signal established by a reference circuit 22. The output from comparator 25 is the function of the difference between the reference signal established by circuit 22 and the detected signal from detector 15.

In a similar manner, the current signal from detector 16 is compared in comparator 24 with a reference signal established by reference circuit 21. The output from comparator 24 is proportional to the difference between the reference signal and the detected signal. The output from detector 16 is also input to an oscillation detector (OSC DET) 18 which functions to detect oscillations in the cell current. Oscillations of cell current of a predetermined frequency produce a signal output from detector 18 which connect to comparator 23. The difference between the detected oscillation signal from detector 18 and a reference signal provided by reference circuit 20 are compared in comparator 23 to produce an output proportional to the difference.

The outputs from comparators 23, 24 and 25 are combined in a conventional logic circuit 26. Logic circuit 26 provides a logical combination of the inputs from comparators 23, 24 and 25 in a conventional manner. For example, the signals from comparators 24 and 25 provide signals which when both are present (logical AND) define gross conditions, such as shorts, in the electrolysis cell. Fine conditions are defined by a signal from comparator 23 and the oscillation detector 18. Whenever the circuit 26 detects a signal from comparator 23, responsive to the presence of oscillations detected by detector 18, servo drive circuit 27 is responsively energized to cause cover drive 9 to raise the cover 8 and thereby increase the anode/cathode spacing. Whenever ocillations are absent, servo drive 27 responds to lower the cover and hence decrease the anode/cathode spacing. The anode/cathode spacing is not decreased, however, beyond an amount determined by the cell potential detector 15 and comparator 25 which prevents the cell potential, Ec, from dropping below a predetermining value. In one example, Ec is not permitted to drop below approximately 4.18 volts. Reference circuit 22 and detector 15 produce an output from comparator 25 which through logic circuit 26 prevents the servo drive 27 from reducing the anode/-cathode spacing any farther.

In the case of a large current increase (e.g. 20% or more), as occurs when a short is present, the detector 16 in combination with the comparator 24 and reference circuit 21 produce an output signal which through circuit 26 overrides all other signals and causes servo drive 27 and cover drive 9 to immediately increase the anode/cathode spacing.

The cell potential and cell current signals vary as a function of temperature, $\tau$. In order to neutralize the effects of temperature, the output from temperature detector 17 is input to shift the reference levels in the reference circuits 20 and 21.

The manual override circuit 28 provides an input to control the servo drive 27. The manual override 28 controls servo drive 27 and responsively the cover drive 9 to raise or lower the cell cover and attached anode. The manual control overrides any signal from the logic circuit 26.

An alarm circuit 41 is provided to indicate alarm conditions which exist in the signal output from circuit 26.

Detectors 15, 16 and 17 are conventional amplifiers which produce an output which is proportional to the input. The oscillation detector 18, the referenced circuits 20, 21 and 22 and the comparators 23, 24 and 25 and the logical circuit 26 may be either analog or digital devices.

In an analog embodiment of the control circuitry of FIG. 1, oscillation detector 18 is a low pass filter with a cutoff frequency of about 10Hz. The magnitude of the oscillations detected by the detector 16 are of the order of 2 out of 20. For a cell current, Ic, of 20K amperes, oscillations of approximately 2K amperes at a frequency of approximately 0.2Hz are detected prior to shorts. Comparator 24 and reference circuit 21 are conventional circuits operable, for example, to detect a 20 percent increase in cell current.

Comparator 25 and reference circuit 22 are conventional devices selected to provide an output if the signals from detector 15 exceed the level of reference 22. In one embodiment, the cell potential Ec is selected to be not less than 4.18 volts and comparator 25 and reference circuit 22 are conventional devices for producing an output whenever detector 15 has an output level representing less than 4.18 volts.

The reference circuit 20 and comparator 23 are connected so that the output from comparator 23 is linear as a function of the output of oscillation detector 18 above a minimum threshold determined by referenced circuit 20. In this operation, the linear output from comparator 23 controls, through circuit 26, servo drive 27 in the absence of any overriding output from comparators 24 and 25. Circuit 26 is a conventional device, such as a bank of summing resistors for analog operation or logical gates (AND, OR, etc.) for digital operation.

While the apparatus of FIG. 1 may be implemented with analog devices, a preferred embodiment is digital as hereinafter described.

Figure 2:
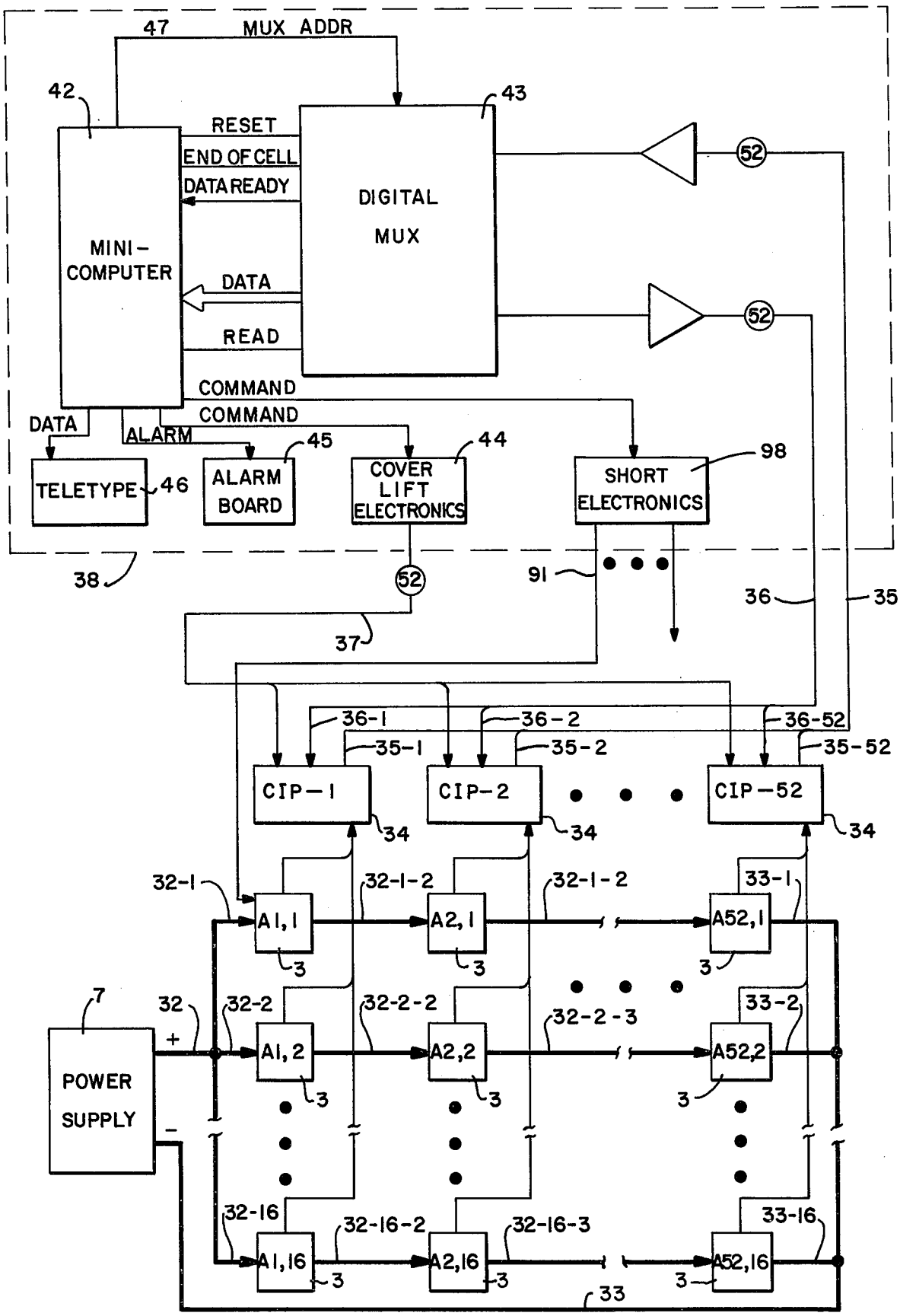
FIG. 2 depicts a schematic representation of an array of 52 electrolysis cells, with sixteen units per cell, connected to a control apparatus in accordance with the present invention.

Digital System — FIG. 2

In FIG. 2, an array of 52 electrolysis cells is depicted. Each cell includes sixteen anode units. For example, the cell 1 includes the units A1,1; A1,2; . . . ; A1,16, the cell 2 includes the units A2,1; A2,2; . . . ; A2,16 and so forth. Each cell receives the sixteen anode buses 31–l through 31–16. The cell units which connect to anode bus 31–1 are the units A1,1; A2,1; . . . ; A52,1.

Each cell and each unit in a cell is connected to a cell instrumentation package (CIP). The 52 cells, cell 1, cell 2, . . . , cell 52 are connected to the cell instrumentation packages CIP-1, CIP-2, . . . , CIP-52, respectively. The anode buses 32 and the cathode buses 33 connect to the power supply 7.

Each cell instrumentation package 34 has an output data line (typically two wires per line) which forms one of the 52 lines in the data bus 35 to the data processor 38. Each cell instrumentation package 34 receives an address line (typically two wires per line) which is one of the 52 lines in the address bus 36 from data processor 38. Each of the cell instrumentation packages also receives a cover lift control line from the 52-line cover lift bus 37.

The data bus 35 and the address bus 36 are controlled by the data processing circuitry in FIG. 2. The data processing circuitry includes a programmable computer 42 and a digital multiplexer 43. In one preferred embodiment, the computer 42 is a NOVA 1200 computer and the digital multiplexer 43 is a model 4100, both manufactured by Data General Corporation.

The digital multiplexer 43 is addressed by the 12-bit MUX ADDR bus 47 from computer 42. The bus 47 is divided into two 6-bit fields. The high order six bits address the 52 cell instrumentation packages. The lower order six bits of the MUX ADDR define the individual measurements for each of the cells of FIG. 2. In each cell, a total of 33 measurements are made, specifically, 16 voltage measurements, 16 current measurements and one temperature measurement. Since there are 33 measurements per cell and since there are a total of 52 cells, a total of 1,716 measurements are made for the 52 electrolysis cells of FIG. 2.

The multiplex address on bus 47 sequentially steps through each of the 1716 addresses. The multiplexer 43 responsively addresses the cell instrumentation packages and the 33 measurements associated with each package. The computer 42 and multiplexer 43 complete the addressing in a fixed cycle period. The cycle period is selected, in one embodiment, to be approximately 0.1 second and therefore a sampling rate of ten samples per second is established. With a sampling rate of ten times per second, the 1,716 measurements are completed ten times per second. The sampling rate determines the highest frequency of oscillation which can be detected by the apparatus of FIG. 2. A sampling rate of ten samples per second will readily allow detection of oscillation frequencies up to five cycles per second. If higher frequencies are to be detected, then the sampling rate must be increased. For readily detecting frequencies of less than approximately one cycle per second, a sampling rate of two samples per second may be employed.

Figure 3:
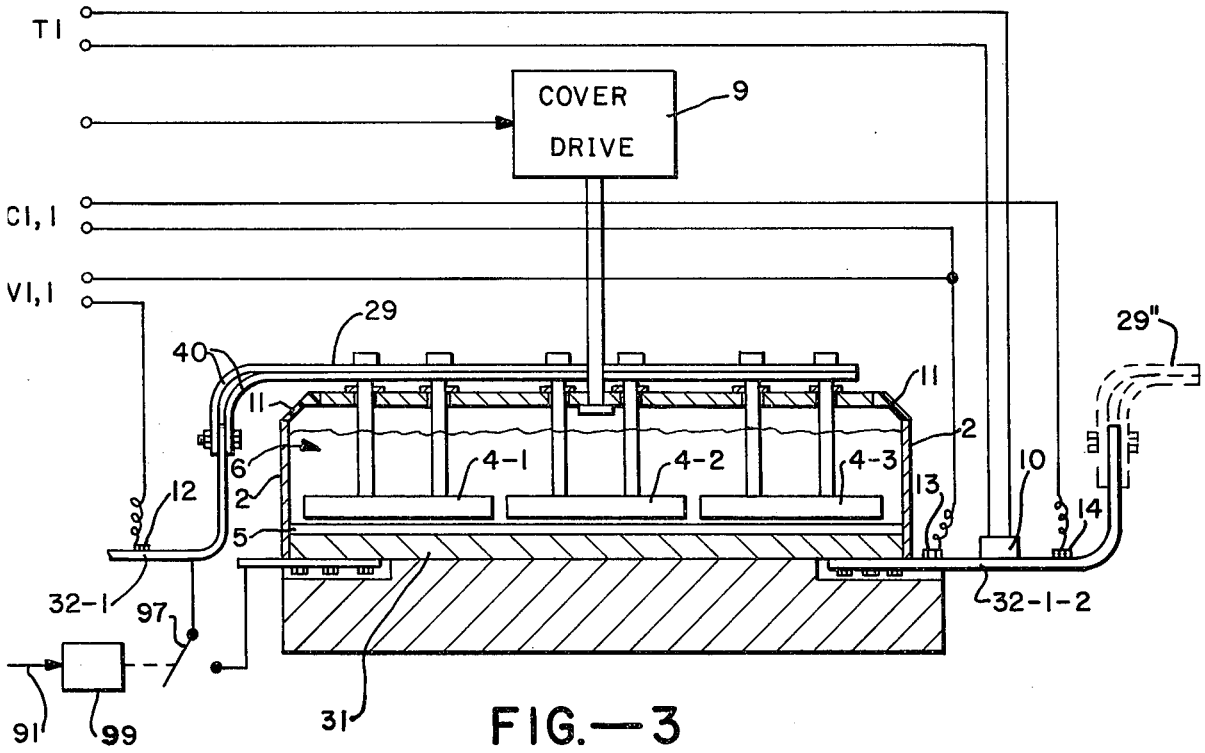
FIG. 3 depicts a cross-section view typical of one of the anode units of a cell in the array of FIG. 2.

Cell Unit — FIG. 3

In FIG. 3, a cross-section of anode unit A1,1 of FIG. 2 is shown. The anode unit includes three anodes 4-1, 4-2 and 4-3 which are electrically connected to the anode bus 29 and mechanically connected to the cell cover 8. The cover 8 and anodes 4-1, 4-2 and 4-3 are raised and lowered by the cover drive 9. The cell walls 2 are rubberized steel and spaced apart approximately 2.3 meters. The mercury cathode 5 sits on a steel bed 31 which is mechanically and electrically connected to the cathode bus 32-1-2. The cathode bus 32-1-2 from cell unit A1,1 (also see FIG. 2) is connected as the anode bus of the adjacent cell unit A2,1.

The terminal 12 is connected to the anode bus 29 and the terminals 13 and 14 are connected to the cathode bus 32-1-2. The cell bus potential, *Eb*, is measured between terminals 12 and 13 to form signal V1,1. The bus current, *Ib*, is measured as the potential difference between terminals 13 and 14.

A flexible rubber skirt 11 forms a seal between the cell walls 2 of the cell cover 8. The skirt 11 allows the cover 8, the anodes 4 and the anode bus 29 to be raised and lowered a short distance without breaking the seal. The anode bus 29 includes flexible straps 40 which connect to bus 32-1 which in turn connects to the power supply 7 of FIG. 2. The temperature transducer 10 is positioned on the cathode bus 32-1-2 for detecting the bus temperature.

Figure 4:
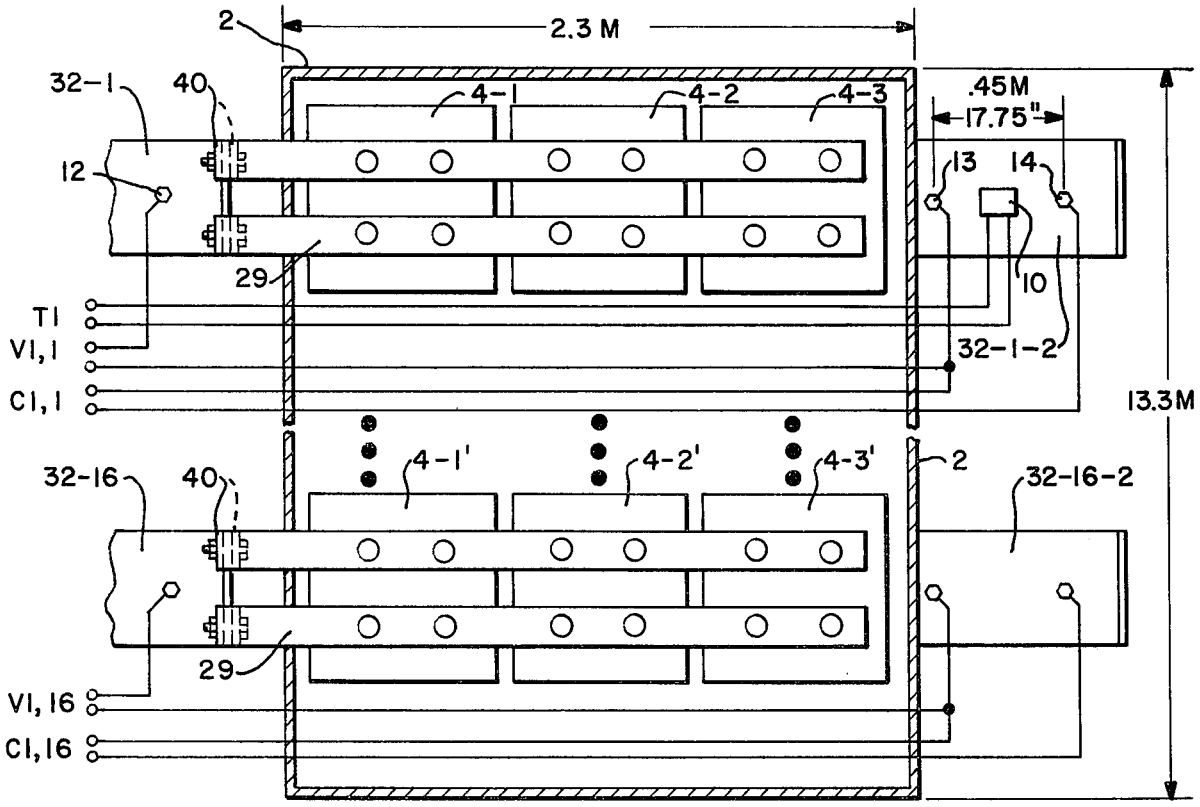
FIG. 4 depicts a top-view of the beginning and ending anode units of a cell in the array of FIG. 2.

Cell — FIG. 4

In FIG. 4, a top view of cell 1, including the anode units A1,1 through A1,16, of FIG. 2 is shown. The cell walls 2 define a chamber approximately 2.3 meters by 13.3 meters. In FIG. 4, only the first anode unit A1,1 and the last anode unit A1,16 are shown. The first anode unit A1,1 is connected to the anode bus 29 which is in turn connected through flexes to the bus 32-1 and the power supply of FIG. 2. Similarly, the anodes 4-1', 4-2' and 4-3' of anode unit A1,16 are connected to a bus 29' which is in turn connected to the bus 32-16 and the power supply of FIG. 2. The cathode bus 32-1-2 associated with anodes 4-1, 4-2 and 4-3 connects from the steel base 31 (see FIG. 3) which is substantially the same size as the area enclosed by the walls 2. The cathode bus 32-16-2 associated with the anodes 4-1', 4-2' and 4-3' also connects to the steel base 31.

In FIG. 4, the anode bus 32-1 has the terminal 12 and the cathode bus 32-1-2 has the terminals 13 and 14. The terminals 12 and 13 provide the contacts for the signal V1,1 and terminals 13 and 14 provide the contacts for the signal C1,1. In the similar manner for anode unit A1,16, terminal 12' is located on bus 29 and terminals 13' and 14' are located on bus 32-16-2. The terminals 12' and 13' provide the signal V1,16 and the terminals 13' and 14' provide the signal C1,16. The temperature transducer 10 provides the signal T1.

Figure 5:
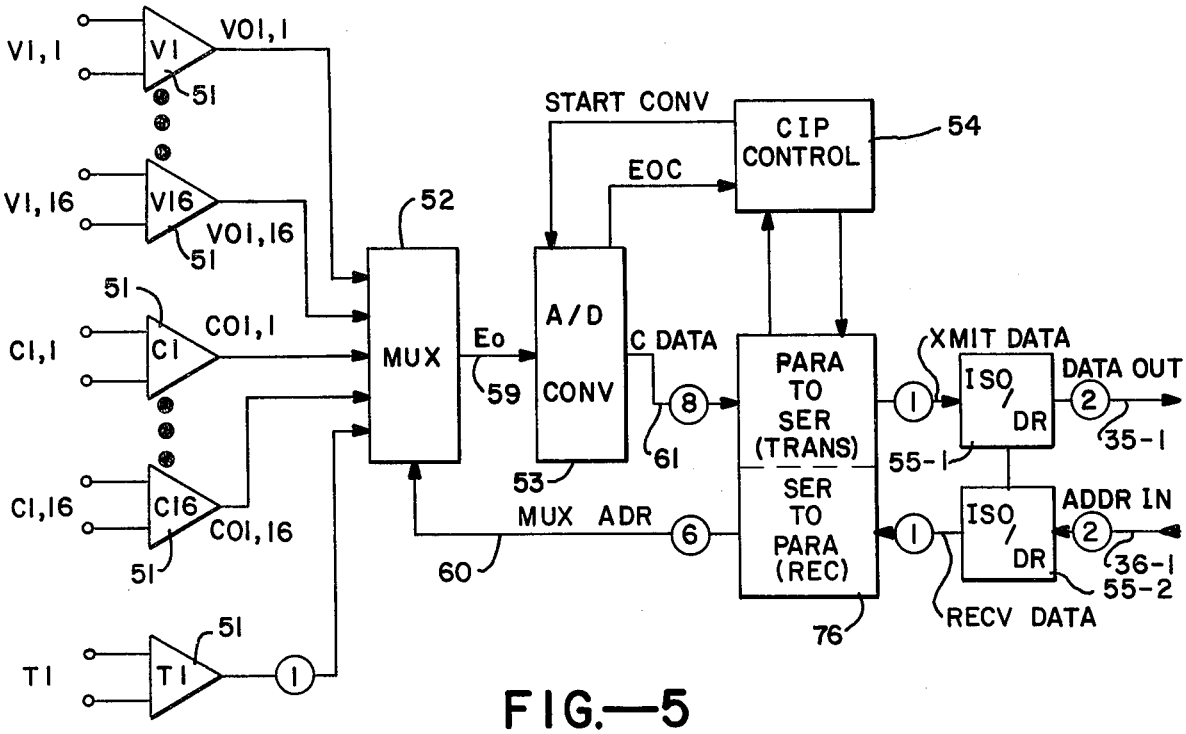
FIG. 5 depicts a schematic representation of a cell instrumentation package (CIP) which is typical of the 52 CIP's employed within the FIG. 2 apparatus.

Cell Instrumentation Package — FIG. 5

In FIG. 5, an overall block diagram of one of the cell instrumentation packages (CIP) 34 of FIG. 2 is shown as typical. The instrumentation package receives the voltage, current and temperature signals of the type indicated in FIG. 3 and FIG. 4. In FIG. 5, those signals are input to the amplifiers 51. The instrumentation package of FIG. 5 functions to select the input signals one at a time, convert them from analog-to-digital form, and transmit them over a DATA OUT bus to the data processor in FIG. 2. The selection is controlled by the address received on the ADDR IN bus.

In FIG. 5, the V1 through V16 amplifiers 51 are conventional devices which are provided for receiving the voltage signals V1,1 through V1,16 from the cell of FIG. 4. Those voltage signals typically range from 0 to 6 volts. Amplifiers V1 through V16 provide the output signals V01,1 through V01,16, respectively, which are input to a multiplexer (MUX) 52.

In a similar manner, the sixteen C1 through C16 amplifiers 51 are also conventional devices which receive the sixteen current signals C1,1 through C1,16, respectively, from the cell of FIG. 4. Those current signals are represented as voltages which are proportional to current and which generally range from 0 to 20 millivolts. The amplifiers C1 through C16 provide the current output signals C01,1 through C01,16, respectively, which are input to the multiplexer 52.

The single temperature output signal T1 is input to the amplifier 51 which is also conventional and which has its single output connected as an input to multiplexer 52.

In FIG. 5, the multiplexer 52 functions to select input lines one at a time to connect to the single EO output line 59. Multiplexer 52 is responsive to the 6-bit address bus 60 for selecting one of the 33 input lines. Multiplexer 52 is a conventional device commonly available under model number AM3705C.

The analog signal on the Eo line 59 from multiplexer 52 is input to a conventional analog-to-digital converter (A/D CONV) 53. Converter 53 is responsive to a command on the START CONV line, from a CIP control 54 to convert the EO signal on line 59 to a digital value on the 8-bit converted data (CDATA) output bus 61. When the conversion has been completed in converter 53, the EOC signal is provided to the CIP control 54 to indicate the end of conversion. The converter 53 is a conventional device which performs a conversion in approximately 100 micro-seconds. The Datel Model ADC-D8B is such a converter.

The output from converter 53 on bus 61 is connected to the transmitter (TRANS) portion of the cell instrumentation package universal asynchronous receiver/-transmitter (UART) 76. UART 76, among other things, converts the 8-bit parallel data on bus 61 to serial data on the XMIT DATA line. UART 76 also has a receive portion (REC) for receiving serial data on the RECV DATA line for producing the 6-bit address on the MUX ADR bus 60 for the multiplexer 52. UART 76, in one more embodiment, is a model TR 1602 manufactured by Western Digital Corporation.

The XMIT DATA line connects through isolator/-driver circuit (ISO/DRIVE) 55-1 having optical isolators which provide up to 1500 volts of DC isolation. The drivers in the circuit 55 convert the 0 and 5 volt XMIT DATA digital potentials to a differential current signal DATA OUT for transmission to the data processing system of FIG. 2. In a similar manner, the receiver path of unit 55-2 contains a line receiver which converts the differential current signal DATA IN from the data processing system to 0 and 5 volt binary signal RECV DATA.

Figure 6:
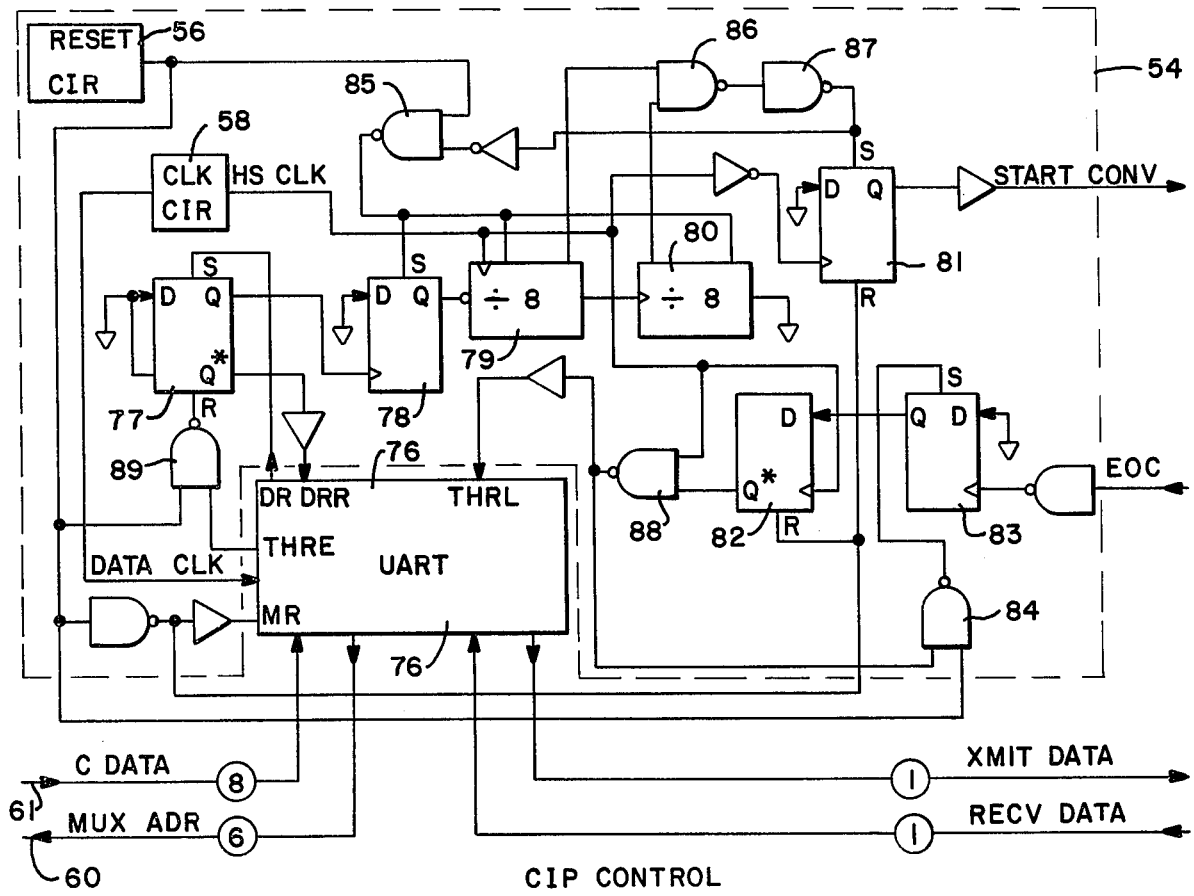
FIG. 6 depicts a schematic representation of the control and transmitter/receiver utilized within the cell instrumentation package of FIG. 5.

Cell Instrumentation Package Control — FIG. 6

In FIG. 6, the CIP control 54 of FIG. 5 is shown in greater detail along with the manner of connecting control 54 to UART 76. The UART 76 receives the parallel input data from the 8-bit C DATA bus 61 and converts it to serial data output on the XMIT DATA line. Serial data into the unit 76 appears on the RECV DATA line and is converted to parallel form for output on the 6-bit MUX ADR bus 60.

The control 54 includes a conventional clock circuit 58. Clock circuit 58 produces a high speed clock (HS CLK) signal which has a frequency 16 times the highest baud rate at which data is to be transmitted by UART 76. In a particular embodiment, the highest transmission rate is 9.6K baud and the lowest transmission rate is 2.2K baud. The DATA CLK signal, input to UART 76, is selected at 16 times the actual operating baud rate which in a typical example is 4.4K baud.

The operation of the UART 76 is described in connection with the waveform of FIG. 7. The waveform shows a typical asynchronous bit stream. Each 8-bit character is preceded by a start bit which is a logic 0 (space). The 8-bit character follows the start bit which is then followed by a stop bit which is a logic 1 (mark). The stop indication can remain for any number of bits.

Figure 7:
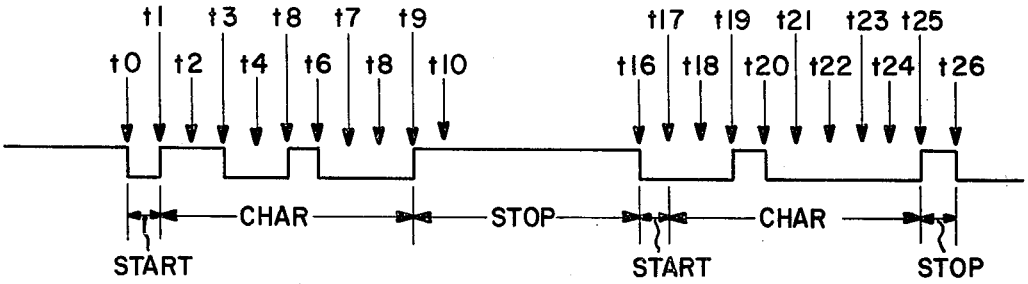
FIG. 7 depicts a waveform representative of the data signal of the CIP control of FIG. 6.

In order to receive a character, the negative-going edge of the start bit at $t0$ in FIG. 7 starts the receiver clock which is utilized to locate the center of each bit. After the start bit which occurs between $t0$ and $t1$, the unit 76 functions to load an 8-bit character, during $t1$ to $t9$, into a shift register internal to the unit 76. Next, the stop bit is received at $t9$ and thereafter the data in the shift register is transferred in parallel to a holding register. One half clock pulse later, between $t9$ and $t10$, the data receive output (DR) in FIG. 6 is set with a 1.

In order to transmit a word, the parallel word on the CDATA bus is loaded into the unit 76 by applying a negative-going transition to the THRL input which thereby functions to load a transmit holding register internal to unit 76. On the positive-going edge of the same pulse, the word is loaded into a transmit register with start and stop bits added for serial transmission between $t16$ and $t26$ of FIG. 7.

In view of the general description of the transmitter/-receiver unit 76, the remainder of the operation of the control of FIG. 6 is now explained. Receipt of any serial data word on the RECV DATA line by the control of FIG. 6 is interpreted as a multiplexer address. When receipt of the word is complete and the STOP bit has been detected, the DR line is set to a 1. That 1 connects to the preset input of conventional D-type flip-flop 77 which then has a 1 on its complementary Q* output. The Q* output feeds to the DRR input of unit 76 to reset the DR output to 0. The transition on the Q output of flip-flop 77 clocks the conventional D-type flip-flop 78 to a 0 on its Q output. That 0 enables conventional divide-by-8 counter 79 to begin counting HS CLK pulses. The parallel outputs from counters 79 and 80 are input to the 2-input NAND gate 86. Depending on which of the parallel outputs from counters 79 and 80 are selected a delay of any quantity up to 64 clock pulses can be achieved. The proper outputs for a delay of 64 are selected in the FIG. 6 embodiments. When the count reaches 64, gate 86 is satisfied to produce an output pulse through inverter 87 which removes the set input from conventional D-type flip-flop 81. The same pulse when inverted is propagated through NAND gate 85 to set flip-flop 78; and conventional reset circuit 56, through gate 85, will also set flip-flop 78. In the preferred embodiment where the delay detected by gate 86 is 64 pulses and where a clock frequency of 153.6 KHz is employed, a delay of about 0.4167 milliseconds occurs. With the set input (S) removed from flip-flop 81, the HS CLK signal clocks flip-flop 81 to a 0 on its Q output thus providing the START CONV signal.

At the time that the DR signal was output from unit 76 to set flip-flop 77, the MUX ADR lines also received the 6-bit address and caused the multiplexer 52 in FIG. 5 to select one of the input signals. The delay of gate 86 enables the multiplexer output on line 59 to settle since multiplexer 52 has a bandwidth of approximately 10 KHz. The START CONV signal causes the conversion to start in converter 53 and when it is complete, the EOC signal has a 1 to 0 transition. When the EOC signal transition occurs, the flip-flop 83 is clocked to produce a 0 on its Q output and thereafter, flip-flop 82 is clocked by the HS CLK signal to store 0 and provide a 1 on its Q* output. That 1 enables NAND gate 88 which, in synchronism with the HS CLK signal, produces a pulse on the THRL input of unit 76. The output from gate 88 also through NAND gate 84 sets flip-flop 83 which in turn causes flip-flop 82 to be clocked with a 0 on its Q* output inhibiting any further output from gate 88. The THRL input to unit 76 occurs for only 1 clock pulse. The leading negative-going transition causes the holding register to be loaded and transmission is started on the trailing positive-going edge. The THRE output signifies that the transmit holding register is empty which through NAND gate 89 resets flip-flop 77 on the positive-going edge to indicate that transmission is complete.

CURRENT AMPLIFIERS — FIG. 8

Figure 8:
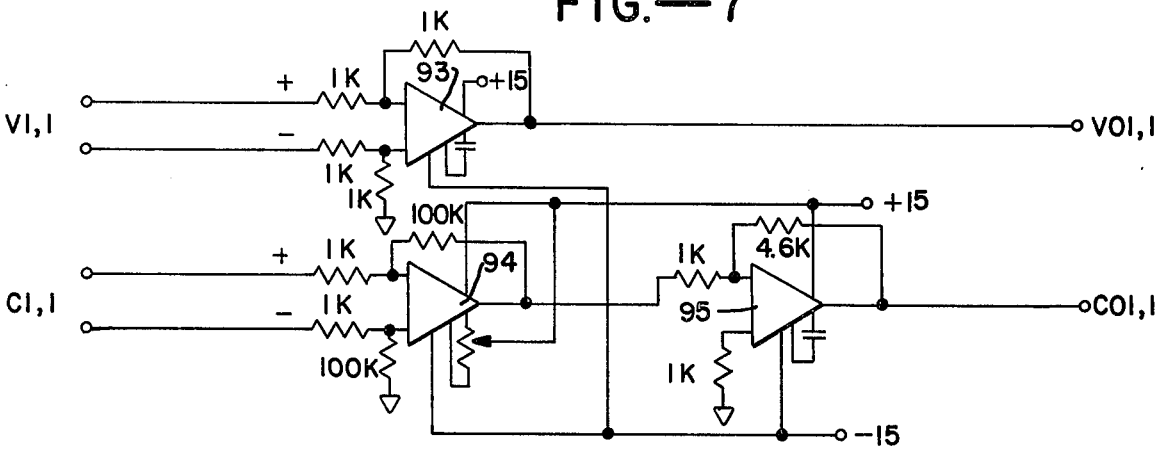
FIG. 8 depicts a schematic representation of the current and voltage detectors associated with one anode unit and employed within the cell instrumentation package of FIG. 5.

In FIG. 8, the unity-gain amplifier 93 receives the input V1,1 signal and produces the output 01,1 signal. Amplifier 93 is typically of the LM301 type. Amplifier 93 and the associated circuitry corresponds to the V1 amplifier 51 in FIG. 5.

In FIG. 8, the amplifiers 94 and 95 and associated circuitry correspond to the Cl current amplifier 51 in FIG. 5. The amplifiers 94 and 95 are conventional amplifiers of the OP-05 and LM301 type, respectively. Amplifier 94 is operated differentially at a gain of approximately 100 and amplifier 95 is operated single ended at a gain of about 5. The current amplifier pair 94 and 95 have a gain at 10 Hz of 460(51dB) and a frequency response from DC to 100 Hz. The amplifier 93 has a gain at 10 Hz of 1 (0dB) with a frequency response from DC to 150 Hz.

ISOLATION/DRIVER — FIG. 9

Figure 9:
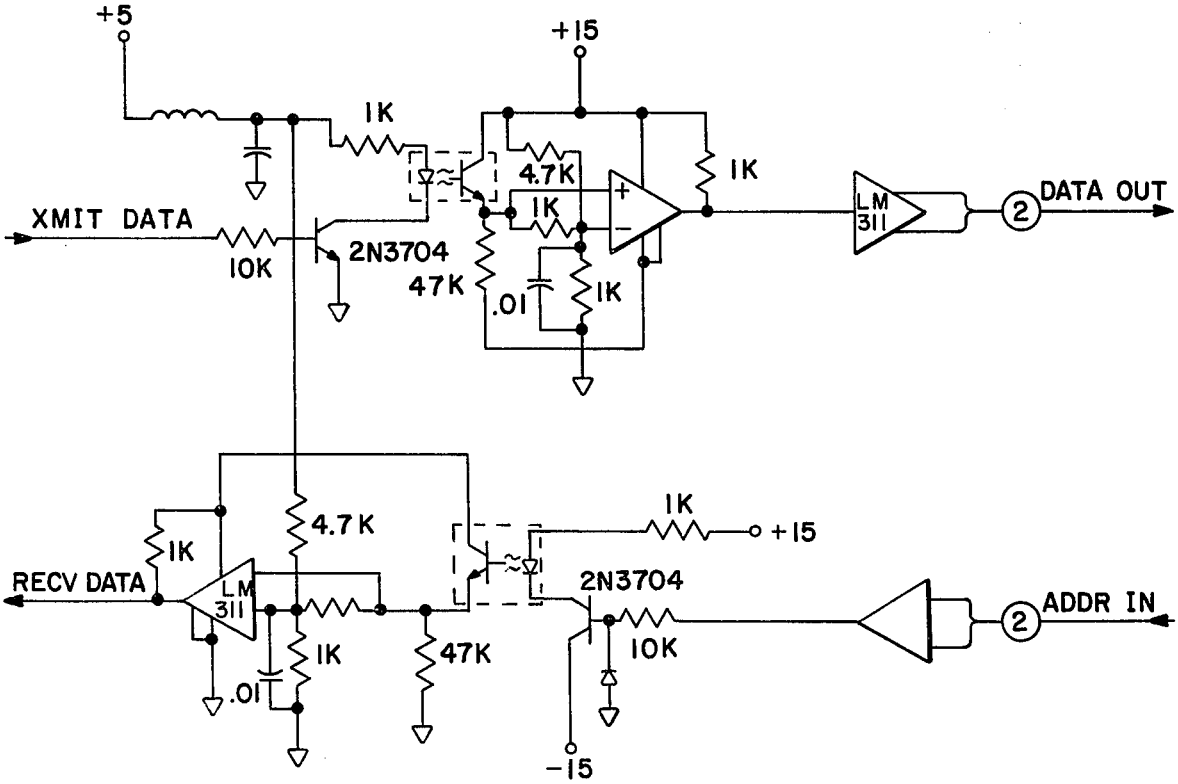
FIG. 9 depicts a schematic representation of the isolator/driver circuit employed within the cell instrumentation package of FIG. 5.

In FIG. 9, the isolation driver circuits 55-1 and 55-2 of FIG. 5 are shown in detail. The transmit path receives the XMIT DATA signal with binary levels of 0 and 5 volts to produce the differential current mode output DATA OUT. Similarly, the receiver path receives the differential current on the DATA IN lines and converts it to a 0 and 5 volt binary signal on the RECV DATA line. Both the transmit and receive paths operate essentially in the same manner. The 2N3704 transistor drives the light emitting diode portion of the optical isolator. The isolator is typically a type 4N26. The LM311 comparator connected to the photo-transistor of the isolator reshapes the output voltage to assure that it is compatible with the logic levels. The two 1K resistors, the 4.7K resistors and the 0.01 microfarad capacitors eliminate uncertainty at the threshold in the presence of noise.

METHOD OF OPERATION

The apparatus of FIG. 2 operates to monitor and control an electrolysis reaction. The monitoring and control functions are carried out by the data processing circuitry 38. Specifically, the computer 42 samples, collects and stores data which is derived through the cell instrumentation packages 34. Also, computer 42 processes the data obtained and controls the electrolysis process in response to processed data. The control may be in the form of alarms and in energizing the cover lift electronics for raising and lowering the covers. To accomplish these tasks, the computer 42, in one preferred embodiment, is programmed with the Real Time Operating System supplied by Data General Corporation for the NOVA 1200 computer.

The data collection function is carried out by the real time operating system of computer 42 by addressing, one at a time, each of the 1,716 measurement locations in FIG. 2. The computer addresses all of the 1,716 measurements up to ten times per second. The addressing is carried out by addressing each of the CIP's of FIG. 2 one at a time. That addressing is carried out typically by a high order 6-bit address. For example, the CIP-1 is the first CIP addressed. During the period when CIP-1 is addressed with one address, 33 measurements associated with CIP-1 are carried out by serially stepping through 33 low-order addresses. First, 16 voltage measurements associated with the 16 units Al,1 through Al,16 are carried out. Thereafter, 16 current measurements associated with the units Al,1 through Al,16 are made. Finally, one temperature measurement is made. After the temperature measurement, the high-order 6-bit address is stepped one count so that the next CIP is addressed. Thereafter, the low-order 6-bit address is incremented 33 times, one address at a time, to obtain in order the 16 voltage measurements, the 16 current measurements and the single temperature measurement.

After completion of the 33 measurements for each CIP, the high order address is again incremented to a new CIP address. For each new CIP address, the 33 low-order addresses are repeated. This process continues until all 52 CIP's have been addressed and all 1,716 measurements have been completed. Thereafter, the addressing process starts all over again in the same manner again addressing the 1,716 measurements. The addressing is carried out so that each of the 1,716 measurements is taken uniformly ten times per second.

Each time the computer 42 steps to a new address, the multiplexer 43 receives that address and sends that address out to the address bus 36. Those addresses are received in the CIP's in the manner previously described in connection with FIGS. 5 and 6. In response to each address, measurement signals are returned over the measurement bus 35 to the digital multiplexer 43. The digital multiplexer 43 in turn transmits the measurements received to the computer 42. Computer 42 has a first set of storage locations for each of the 1,716 measurement signals obtained. There is a one to one correspondence between those memory locations within computer 42 and the addresses which appear on bus 47. A second set of locations is included within computer 42, for storing 1,716 measurements. Each time a new measurement is addressed and received from the electrolysis apparatus of FIG. 2, the measurement is stored in one of the first set of 1,716 locations. Any previous measurement in that location is transferred to one of the second set of 1,716 locations. For example, the first measurement, associated with CIP-1 and the first unit Al,1 is the voltage measurement Vl,1 and V01,1 of FIG. 7. That measurement value is transmitted and stored in a particular location (e.g. Vb1) of computer 42. After the remaining 1,716 measurements are made (each being stored in a different Vb1 location), the second set of 1,716 measurements are made while the initial contents of the Vb1 locations are transferred to new locations (e.g. Vb2) in computer 42. Since there are 832 voltage measurements, there are 832 Vb1 and 832 Vb2 locations within computer 42.

In a similar manner, there are 832 Ib1 and Ib2 locations within computer 42 for storing current measurements and 52 Tl locations for storing temperature measurements. The current and temperature measurements are addressed, stored in the Ib1 and Tl locations, and then current is transferred to the Ib2 locations. The addressing, storing and transferring steps operate on a real time basis and therefore constitute a data sampling operation.

In addition to the data sampling, collection and storage operation, the computer 42 additionally performs real time computations in order to provide the monitor and control signals associated with the FIG. 2 apparatus.

The computations include generation of (1) individual anode potential limit alarms, (2)average anode/cathode potential limit alarms, (3) individual bus current limit alarms, (4) individual bus current fluctuation alarms and (5) anode/cathode short alarms.

The individual anode/cathode potential limit alarms include both an upper limit alarm and a lower limit alarm. An upper limit alarm is generated by computer 42 if any individual anode/cathode potential exceeds the voltage upper limit, VUL, as defined by the following equation:

$$VUL = \frac{(1 + K1)}{16} \sum_{v=1}^{16} V[v] \qquad \text{Eq. (4)}$$

where:

$V[v]$ = individual bus potential $K1$ = preset fraction (e.g.$\frac{1}{2}$)

$v$ = cell bus number = 1, 2, . . . ,16

It is evident from Eq. (4) that the upper limit VUL is some increment, established by the constant Kl, greater than the average potential for all of the buses within one cell.

In a similar manner, a voltage lower limit (VLL) for the anode/cathode potential is defined by the following equation:

$$VLL = \frac{(1 - K1)}{16} \sum_{v=1}^{16} V[v] \qquad \text{Eq. (5)}$$

The computer 42 performs the calculations for VUL and VLL for each cell in a conventional manner. Each individual anode/cathode potential $V[v]$ is compared with the VUL values. If any value of $V[v]$ is greater than VUL or is less than VLL, then computer 42 generates an alarm signal. That alarm signal is connected to the alarm board 45. Alarm board 45 may include a bell, lamp or any other indicating device to indicate the alarm condition. Also a teletype 46 in FIG. 2 is provided and alarms may be output there in a conventional manner.

The anode/cathode potential limit alarm is generated by comparing the average anode/cathode potential, Vave, with predetermined upper and lower limits. The value of Vave is determined by the following equation:

$$Vava = \frac{1}{16} \sum_{v=1}^{16} V[v] \qquad \text{Eq. (6)}$$

The individual bus current limit alarms include both an upper limit, IUL, and a lower limit, ILL, as given by the following equations:

$$IUL = \frac{(1 + K2)}{16} \sum_{u=1}^{16} C[u] \qquad \text{Eq. (7)}$$

$$ILL = \frac{(1 - K2)}{16} \sum_{u=1}^{16} C[u] \qquad \text{Eq. (8)}$$

The computer 42 performs the calculations of Eq. (7) and Eq. (8) in a conventional manner and compares IUL and ILL with each of the 16 values of $C[u]$. If any value of $C[u]$ exceeds IUL or is less than ILL, then an alarm is generated. The values IUL and ILL define predetermined deviations from the average current. The amount of deviation is controlled by the magnitude of K2. The average current is given by Eq. (6) or Eq. (7) if K2 is made equal to zero.

An individual bus current fluctuation alarm is generated if oscillations in individual bus currents are detected. The presence of the oscillations is determined whenever a threshold integration function, $Xb$, exceeds a predetermined limit, K3. The function $Xb$ is defined by the following equation:

$$Xb = \sum_{n=1}^{\infty} Yb[n] \qquad \text{Eq. (9)}$$

In equation 9, the function $Yb[n]$ is equal to one of three values, 1, 0, or $-1$.

The value for $Yb$ is determined by the valuation of the quantity $\Delta Ib$ where $\Delta Ib$ is the absolute value of the difference between $Ib1$ and $Ib2$. The values $Ib1$ and $Ib2$ are two successive measurements of bus current for an individual bus. A new bus current measurement is stored in an $Ib1$ location while the previous measurement is moved from the $Ib1$ location to the $Ib2$ location. Each new $Ib1$ measurement occurs at the sampling interval, $\Delta t$, which is typically every 0.1 second. The $\Delta Ib$ value formed every $\Delta t$ is a differential function $\Delta Ib/\Delta t$ where $\Delta t$ is a sampling interval.

If $\Delta Ib$, as formulated every $\Delta t$, is greater than a quantity $\epsilon$, the value of $Yb$ is equal to 1. If $\Delta Ib$ is less than $\epsilon$, then $Yb$ is equal to 0 if $Xb$ is equal to 0, or $Yb$ is equal to $-1$ if $Xb$ is greater than 0. Where the value $Xb$ has a range between 0 and 256, the value of $\epsilon$ is equal to a small number such as 4. While many values of $\epsilon$ can be selected, $\epsilon$ generally is selected less than ten percent of the maximum $Xb$ value.

The process of adding 1, 0, or $-1$ to the previous sum of $Xb$ is defined by Eq. (9). Each new value of $Ib1$ is a new value for "$n$" in Eq. (9). Eq. (9) is a threshold approximation of integrating the differential$\Delta Ib/\Delta t$. Integration of that differential forms the value $Xb$ which is approximately proportional to the derivative of the bus current. A threshold integration function $Xb$ occurs, of course, for every one of the 832 individual buses in the electrolysis apparatus of FIG. 2. If any one of those 832 values for $Xb$ exceeds a constant K3, then an alarm is generated. Where direct control of the anode covers is desired, the cover lift electronics provides a signal to lift the covers whenever $Xb$ exceeds the threshold K3. The covers are lowered whenever the value of $Xb$ is less than K3. In this manner, cover lifts may be automatically controlled in response to the $Xb$ signal.

In light of the above discussion, the details of a suitable program for computer 42 to carry out the processing will be apparent to those skilled in the art. The Real Time Operation System provided by Data General Corporation in combination with the NOVA 1200 computer is a suitable vehicle for implementing those programs. Additionally, the following program presented in TABLE I and TABLE II will be explained as a representative of such programs.

In TABLE I, the steps of S1 through S18 are sequentially executed by the computer 42 of FIG. 2.

In Step S1, one of the CIP's 35 in FIG. 2 is addressed on the address bus 47. The particular one of the CIP's addressed is determined by the value of $u$ where $u$ has a value between 1 and 52. When the program starts, $u$ is initially equal to 1. With $u$ equal to 1, the CIP-1 in FIG. 2 is addressed.

In Step S2, the voltage measurement V[$v$] is addressed. Initially, the V is equal to 1 which signifies that the voltage V1,1 in FIG. 5 is addressed. When addressed, voltage measurement is returned to the digital multiplexer 43 and from there to the computer 42.

In Step S3, the V1,1 value of the V[$l$] measurement is stored in computer 42.

In Step S4, the program of TABLE I jumps to a subroutine program SUB-I to determine if a potential alarm should be generated as a result of the voltage measurement stored in S3. The SUB-1 subroutine is implemented to perform the calculations of Eqs. (4) and (5). After completion of SUB-1, the subroutine returns to Step S5.

In Step S5, +1 is added to the value of $v$.

In Step S6, $v$ is compared to the constant 16. If $v$ is greater than 16, then the program goes to Step S7. The steps

TABLE I

| | | |
|---|---|---|
| S1 | ADDRESS CIP[u] | [u = 1, 2, . . . 52] |
| S2 | ADDRESS V[v] | [v = 1, 2, . . . 16] |
| S3 | STORE V[v] | |
| S4 | JUMP TO SUB-I (Potential Alarm) - [Return S5] | |
| S5 | ADD +1 to v | |
| S6 | COMPARE v to 16: | |
| | If v ≦ 16, go to S2 | |
| | If v > 16, go to S7 | |
| S7 | ADDRESS C[w] | [w = 1,2, . . . 16] |
| S8 | TRANSFER Ib1 to Ib2 | |
| S9 | STORE C[w] in Ib1 | |
| S10 | JUMP TO SUB-II (Current Fluctuation Alarm)- [Return S11] | |
| S11 | JUMP TO SUB-III (Current Limit Alarm) - [Return S12 ] | |
| S12 | ADD +1 to w | |
| S13 | COMPARE w to 16: | |
| | If w ≦ 16, go to S7 | |
| | If w > 16, go to S14 | |
| S14 | ADDRESS T | |
| S15 | ADD +1 to u | |
| S16 | COMPARE u to 52: | |
| | If u ≦ 52, go to S1 | |
| | If u > 52. go to S17 | |
| S17 | SET u = 1, | |
| S18 | JUMP to S1 | |

TABLE II

| | |
|---|---|
| SS1 | SUBTRACT Ib2 from Ib1 to form ΔIb = Ib1 − Ib2 |
| SS2 | COMPARE Xb [n] with 0: [n = 1, 2, . . . ] |
| | If Xb = 0, go to SS3 |
| | If Xb ≧ 0, go to SS4 |
| SS3 | COMPARE ΔIb with ϵ: |
| | If ΔIb < ϵ, go to SS5 |
| | If Xb ≧ 0, go to SS7 |
| SS4 | COMPARE ΔIb with ϵ: |
| | If ΔIb < ϵ, go to SS9 |
| | If Ib ≧ ϵ, go to SS7 |
| SS5 | SET Yb = 0 |
| SS6 | JUMP TO SS10 |
| SS7 | SET Yb = +1 |
| SS8 | JUMP to SS10 |
| SS9 | SET Yb = −1 |
| SS10 | ADD Yb to Xb[n] to form Xb [n + 1] = Xb[n] + Yb |
| SS11 | COMPARE Xb[n + 1] with K3, |
| | If Xb[n + 1] ≧ K3, go to SS12 |
| | If Xb[n + 1] < K3, go to SS13 |
| SS12 | SET ALARM [dI/dt] |
| SS13 | JUMP TO S11 |

S2 through S6 are a loop which functions to address, store and process the sixteen voltage measurements within the particular CIP addressed in Step S1.

After the sixteen voltage measurements have been processed, a second loop comprising Steps S7 through S13 is entered to process the 16 current measurements associated with the CIP specified in Step S1. The quantity $w$ equals the values of 1 through 16. In Step S7, the value of $w$ is equal initially to 1. With a $w$ equal to 1, the current measurement C1,1 of FIG. 5 is addressed. In Step S8, the contents of a storage location I$b$1, in computer 42 is transferred to location I$b$2 to make room for the measurement of S7.

In Step S9, the C[$w$] measurement of Step S7 is stored into a first Ib1 location of computer 42.

In Step S10, the program of TABLE I jumps to a subroutine, SUB-II. The SB-II subroutine is shown in TABLE II.

In TABLE II, the step SS1 forms the quantity ΔI$b$ by subtracting I$b$2 from I$b$1. There are I$b$1 and I$b$2 locations in computer 42 for each of the 832 current measurement associated with the apparatus of FIG. 2. Accordingly, the subroutine of TABLE II is repeated 832 times, once each time one of the current measurements of FIG. 2 is addressed.

In Step SS2, the quantity Xb is compared with 0. The quantity X$b$ is the running integration function defined by Eq. (9) above. If X$b$ is equal to 0, then the subroutine goes to Step SS3. If X$b$ is greater than 0, then the subroutine goes to SS4. There are 832 different X$b$ quantities, one for each of the current measurements in FIG. 2.

In Step SS3, the quantity ΔI$b$ formed in Step SS1 is compared with the quantity ϵ. If ΔI$b$ is less than ϵ, then the subroutine jumps to Step SS5 to set the quantity Y$b$ equal to 0. If ΔIb is greater than or equal to ϵ, then the program goes to Step SS7 to set the quantity Y$b$ equal to +1.

In Step SS4, the quantity I$b$ is compared with ϵ. If ΔI$b$ is less than ϵ, then the subroutine goes to Step SS9 to set Y$b$ equal to −1. If ΔI$b$ is greater than or equal to ϵ, then the subroutine goes to Step SS7 to set the Y$b$ equal to +1. During any one pass through the subroutine of TABLE II, the value of Y$b$ is set to only one of the values 0, +1, or −1.

In Step SS10, the newly determined value of Y$b$ is added to the threshold integration function Y$b$[$n$] to form a new value X$b$[$n$+1]. In a subsequent pass through TABLE II for the same current measurement, the new value Xb[$n$+1] becomes the old value X$b$[$n$]. The variable $n$ has no upper limit.

In Step SS11, the newly formed value X$b$[$n$+1] is compared with the constant K3. If greater than or equal to K3, then the subroutine jumps to SS12 and if less than K3, then the subroutine jumps to SS13.

In Step SS12, the subroutine sets an alarm thereby indicating that a current oscillation proportional to D$I/dt$ has been detected.

In Step SS13, the subroutine returns to Step S11 of the program of TABLE I.

In Step S11, the program of TABLE I jumps to a subroutine SUB-III to provide a current limit alarm. The current limit alarm is analagous to the potential alarm of Step S4. The current alarms are implemented to carry out the calculations of Eq. (7) and Eq. (8).

In Step S12, +1 is added to $w$.

In Step S13, the value of $w$ is compared to 16. If $w$ is less than or equal to 16, then the program jumps to Step S7. The Steps S7 through S13 are a loop for performing the calculations for all sixteen of the currents associated with CIP addressed in Step S1. After the sixteenth measurement signal, $w$ greater than 16, the program goes to Step S14.

In Step S14, the single temperature measurement associated with the CIP addressed in Step S1 is performed.

In Step S15, +1 is added to $u$.

In Step S16, $u$ is compared to the quantity of 52. If $u$ is less than or equal to 52, then the program jumps back to Step S1. The Steps S1 through S16 are a loop which is repeated once for each of the 52 CIP's in FIG. 2. After the 52and completion, $u$ greater than 52, the program goes back to Step S17.

In step S17, the quantity $u$ is set equal to 1.

In Step S18, the program jumps back to Step S1 with the value of $u$ equal to 1 so that the program is again repeated in the manner previously described.

ANODE ADJUSTMENT

Figure 10:
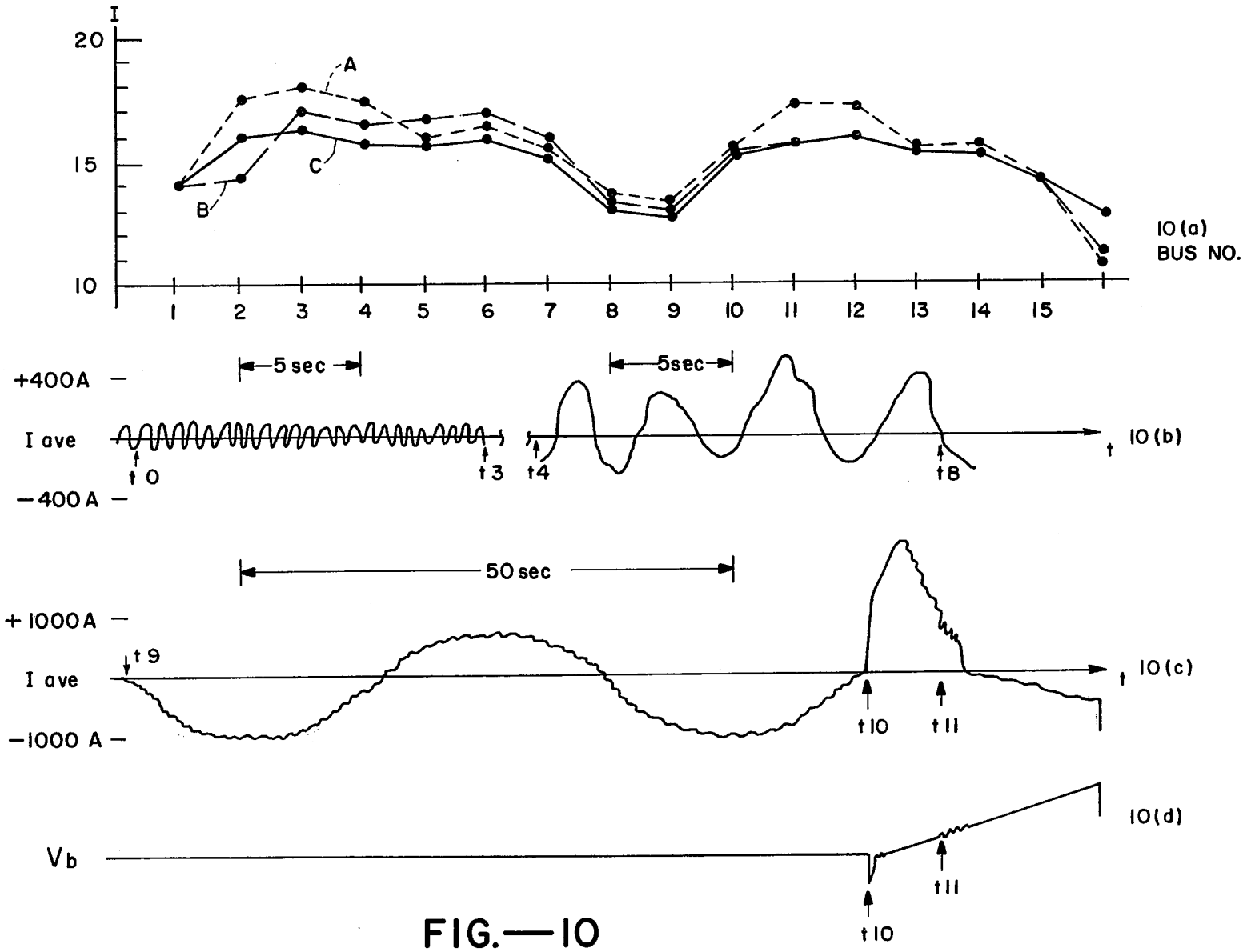
FIG. 10 depicts waveforms representative of bus current and bus to anode voltages which are detected in accordance with the present invention.

In FIG. 10*a*, the A, B and C graphs represent the busbar current distribution on a typical one of the 52 cells of FIG. 2. In FIG. 10*a*, the overall power supply current on bus 32 of FIG. 2 is represented as I and is in units of thousands of amperes (KA). The other axis in FIG. 10*a* identifies the bus numbers (BUS NO.) 1 through 16 which represent, for example, the busbars (buses) (31–1 through 32–16 in FIG. 2.

In FIG. 10*a*, the broken line A represents the current distribution on the busbars prior to any adjustment of the anodes. The total current load equals 235KA, the average anode to cathode voltage is 4.74 volts, and the total power consumed is 1113.9 kilowatts.

In FIG. 10*a*, the broken line B represents the redistribution of current throughout the buses. The redistribution is effected by changing the relative heights of the anodes but without lowering the cover which controls the spacing for all anodes within a cell. For line B, the total current load is 242KA, the average anode to cathode voltage is 4.56 volts and the total power consumed is 1103.52 kilowatts.

In FIG. 10*a*, solid line C represents the current distribution after lowering the cell cover and hence a lowering of all anodes in the cell. For Line C, the total current is 240KA, the average potential is 4.41 volts, and the total power is 1058.4 kilowatts. The saving of power in the change from A to C operation is therefore 55.5 kilowatts. For operation 24 hours a day, 7 days a week, and 50 weeks a year, a total saving of 8.4 thousand kilowatt hours can be estimated.

The savings, of course, results from the ability to lower the cell covers the hence to reduce the anode cathode spacing. Such a reduction is not generally possible without the monitoring and control operations performed by the present invention. If the reduction in cell covers carried out between A and C lines in FIG. 10*a* is undertaken without control and monitoring as provided by the present invention, then the frequency of shorts is likely to be increased and the severity of the damage resulting from the shorts is also likely to be increased.

Using the control and monitoring functions of the present invention, however, not only is the voltage and power consumption reduced, but the frequency and severity of shorts is also reduced. With these reductions, the manpower required for anode adjusting and other cell maintenance is reduced. These features of the invention are achieved by employing the control parameters and processing steps described in connection with the programs of TABLES I and II above.

Of particular significance is the feature of the invention which provides the ability to detect current oscillations in individual busbars (for example, busbars 32-1 through 31-16 of FIG. 4) within the cell.

In FIG. 10*b*, the current, I, versus time, *t*, on a typical one of the busbars in a typical cell is shown. For a long period prior to *t*0 and *t*3, the current fluctuation about the average value Iave is small. The average current is typically of the order of 15 to 20 kiloamps. At a time betwen t3 and t4, the cell cover is lowered in a manner described in connection with FIG. 10*a*. In the FIG. 10*b* example, lowering the cover results in a current oscillation which is shown between *t*4 and *t*8. The duration of that oscillation generally continues for a much longer time than shown in FIG. 10*b*. The amplitude of the oscillation around the 15KA average is of the order of ± 400 amperes. It has been discovered, in accordance with the present invention, that oscillations of the type shown between *t*4 and *t*8 are precursors of shorts. When an oscillation of this type occurs in any busbar within the FIG. 2 apparatus, a current fluctuation alarm is produced in the manner previously described. (See Step SS12 of TABLE II.) When the alarm is generated, an operator manually initiates the raising of the cell covers. The covers are typically raised until the alarm disappears. In an alternate embodiment, the alarm signal from Step SS12 is employed to raise automatically the cell covers.

Raising of the cell covers causes fluctuation of the FIG. 10*b* waveform to be removed. After raising of the covers, the waveform from t4 through t8 again appears like the waveform between *t*0 and *t*3.

In FIG. 10*c*, another waveform is shown representative of a bus current as a function of time. Between the times *t*9 and *t*10, the waveform of FIG. 10*c* exhibits an oscillation which is a precursor to a short and which results in a short circuit approximately at *t*10.

In FIG. 10*d*, the anode to cathode voltage across the anode receiving the bus current of FIG. 10*c* is shown. After the initial drop in potential at *t*10, due to the short, a linear increase occured because the covers were lifted and hence the anode/cathode spacing was increased.

FURTHER EMBODIMENTS

Additional apparatus for controlling the electrolysis reaction is provided in FIGS. 2 and 3. In FIG. 3, that apparatus includes a current by-pass switch 97. Switch 97 is connected on one side to bus 32-1 and on the other side to the steel bed 31. As long as switch 97 is open (as shown), current is conducted as previously described between bus 32-1 and conductors 29, through the anodes 4-1, 4-2 and 4-3 to cathode 5 and steel bed 31. When switch 97 is closed, however, current is conducted directly form bus 32-1 to steel bed 31 and no current is conducted from anodes 4-1, 4-2 and 4-3 to cathode 5. Switch 97 is useful, therefore, in removing the anode unit of FIG. 3 from operation while allowing the other serially connected anode units (A2,1 through A52, 1 of FIG. 2) to remain operating.

While one typical switch 97 has been shown in FIG. 3, each of the other anode units of FIG. 2 typically includes a current by-pass switch like switch 97.

In FIG. 3, the switch 97 in one embodiment may be manually operable. In another embodiment, switch 97 is operated by an electrical switch control 99. Control 99 and switch 97 are typically a solenoid operated switch having consumable contracts. Any conventional switch and switch control capable of switching high currents may be employed.

In one preferred embodiment, the switch control 99 for each anode unit is actuated by the short electronics 98 in the data processing circuitry 38 of FIG. 2. The short electronics 98 is typically a register with one location for each of the switches and controls 97 and 99.

Whenever the register location for a corresponding switch control is in one state (e.g. binary 0), the corresponding switch 97 is open. Whenever the location is in the other state (e.g. binary 0), the corresponding switch 97 is closed. The 1 or 0 states of the locations are typically set under command from the computer 42. The command to close a switch from the computer 42 may be generated, for example, whenever a short alarm is generated.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method for controlling an electrolysis reaction in an apparatus having a plurality of anode units positioned above at least one cathode where current is conducted between each anode unit and a cathode comprising the steps of, generating a plurality of current measurement signals, one for each of said anode units, where each of said current measurement signals is proportional to the current in a different one of said anode units, detecting each of said current measurement signals to detect changes in current with respect to time in any of said anode units which exhibit oscillations having a frequency of less than approximately one cycle per second, generating an oscillation alarm signal in response to detection of said oscillations, forming an average current signal as the average value of said current measurement signals, comparing each of said current measurement signals with a predetermined limit signal to form a current alarm signal whenever one of said current measurement signals exceeds a predetermined deviation from said average current signal.

2. A method for controlling an electrolysis reaction in an apparatus having a plurality of anode units positioned above at least one cathode where current is conducted between each anode unit and a cathode comprising the steps of, generating a plurality of current measurement signals, one for each of said anode units, where each of said current measurement signals is proportional to the current in a different one of said anode units, detecting each of said current measurement signals to detect changes in current with respect to time in any of said anode units which exhibit oscillations having a frequency of less than approximately one cycle per second, generating an oscillation alarm signal in response to detection of said oscillations, generating a plurality of voltage measurement signals, one of each of said anode units, where each of said voltage measurement signals is proportional to the voltage between a different one of said anode units and a cathode, comparing each of said voltage measurement signals with a voltage limit signal to provide a limit alarm signal whenever any of said voltage measurement signals exceeds said voltage limit signal.

3. A method for controlling an electrolysis reaction in an apparatus having a plurality of anode units positioned above at least one cathode where current is conducted between each anode unit and a cathode comprising for each of said anode units the steps of, generating a current measurement signal proportional to the current in a different one of said anode units, generating periodically each increment of time a current change signal as a function of said current measurement signal, comparing said current change signal with a predetermined constant change signal, storing an accumulated measurement signal, incrementing or decrementing said accumulated measurement signal as a function of whether said current change signal is greater than or less than, respectively, said predetermined constant change signal, comparing said accumulated measurement signal with a predetermined measurement constant to form an indication that oscillations are present when said accumulated measurement signal exceeds said predetermined measurement constant.

4. The method of claim 3 including the step of, increasing the anode/cathode spacing in response to said indication.

5. The method of claim 3 including the steps of, forming a current upper limit signal equal to a predetermined deviation greater than the average value of said current measurement signals, forming a current lower limit signal equal to a predetermined deviation less than the average value of said current measurement signals, comparing each of said current measurement signals with said current upper limit and said current lower limit signals to form a current alarm signal whenever one of said current measurement signals is greater than said current upper limit signal or less than said current lower limit signal.

6. The method of claim 3 including the steps of, generating a plurality of voltage measurement signals, one for each of said anode units, where each of said voltage measurement signals is proportional to the voltage between a different one of said anode units and a cathode, forming a voltage upper limit signal equal to a predetermined deviation greater than the average of said voltage measurement signals, forming a voltage lower limit signal equal to a predetermined deviation less than the average of said voltage measurement signals, comparing each of said voltage mesurement signals with said voltage upper limit signal and said voltage lower limit signal to from a voltage alarm signal whenever one of said voltage measurement signals is greater than said voltage upper limit signal or less than said voltage lower limit signal.

7. The method of claim 5 including the steps of, forming a current upper limit signal equal to a predetermined deviation greater than the average value of said current measurement signals, generating a plurality of voltage measurement signals, one for each of said anode units, where each of said voltage measurement signals is proportional to the voltage between a different one of said anode units and a cathode, forming a voltage lower limit signal equal to a predetermined deviation less than the average value of said voltage measurement signals, comparing each of said current measurement signals with said current upper limit signal to form a current upper limit alarm signal whenever one of said current measurement signals exceeds said current upper limit signal, comparing each of said voltage measurement signals with said voltage lower limit signal to generate a voltage lower limit alarm signal whenever one of said voltage measurement signals is less than said voltage lower limit alarm signal, generating a short alarm signal whenever said current upper limit alarm signal and said voltage lower limit alarm signal are present for the same anode unit.

8. The method of claim 7 including the step of increasing the spacing between the anodes and cathode in response to said short alarm signal.

9. The method of claim 3 including the step of, controlling the spacing between said anode units and cathode in response to said current measurement signals and increasing said spacing in response to said indication.

10. The method for controlling an electrolysis reaction with apparatus including a power supply, a plurality of buses, a plurality of anode units where each anode unit is connected to a different bus, where the andoe units are positioned in proximity to a cathode and immersed in an electrolyte and where current is conducted from the power supply through the buses, from anode to cathode through the electrolyte, the steps comprising, sensing the current in each of said buses to form, for each anode unit, a current measurement signal having an amplitude proportional to the current in the respective anode unit, periodically sampling, for each anode unit, said current measurement signal to form a first sampled current measurement signal each increment of time, $\Delta t$, and where each first sampled current measurement signal becomes a second sampled current measurement signal after an increment of time, $\Delta t$, generating periodically each increment of time $\Delta t$ a current change signal, $\Delta Ib$, for each anode unit, where $\Delta Ib$ is equal to the difference between the first sampled current measurement signal and the second sampled current measurement signal, comparing each current change signal, $\Delta Ib$, with a predetermined constant signal, $\epsilon$, for each anode unit, storing an accumulated measurement signal, $Xb$, for each anode unit, adding, for each anode unit, said accumulated measurement signal, $Xb$, to an incremental quantity, $Yb$, where $Yb$ varies as a function of whether said current change signal is greater than or less than said predetermined constant signal, $\epsilon$, comparing, for each anode unit said accumulated measurement signal, $Xb$, with a predetermined measurement constant to form an indication of oscillation when said accumulated measurement signal, $Xb$, exceeds said predetermined measurement constant, changing the spacing between the anodes and cathode in response to said indication of oscillation.

11. The method of claim 10 wherein said increment of time, $\Delta t$, is equal to approximately 0.1 second.

12. The method of claim 10 wherein, when the current change signal, $\Delta Ib$, is greater than $\epsilon$, said incremental quantity, $Yb$, is equal to 1 and wherein when $\Delta Ib$ is less than $\epsilon$, $Yb$ is equal to 0 if $Xb$ is equal to 0 and $Yb$ is equal to $-1$ if $Xb$ is greater than 0.

13. The method of claim 10 wherein said accumulated measurement signal, $Xb$, has a predetermined maximum and said constant signal, $\epsilon$, has a magnitude which is less than approximately 10% of said maximum.

14. The method of claim 10 wherein said current measurement signal is an analog signal and including the step of, converting said sampled current measurement signal to a digital signal whereby said current change signal, for each anode unit, is a digital signal and whereby said comparing, said storing, said adding, and said comparing steps are performed with digital values.

15. The method of claim 10 including the steps of, forming a current upper limit signal equal to a predetermined deviation greater than the average value of said current measurement signals for all of said anode units, forming a current lower limit signal equal to a predetermined deviation less than the average value of said current measurement signals for all of said anode units, comparing each of said current measurement signals with said current upper limit signal and said current lower limit signal to form a current upper limit alarm signal whenever one of said current measurement signals is greater than said current upper limit signal, and to form a current lower limit alarm signal whenever one of said current measurement signals is less than said current lower limit signal, sensing the voltage from anode to cathode, for each anode unit, to form a voltage measurement signal having an amplitude proportional to said voltage for each respective anode unit, periodically sampling said voltage measurement signal, for each measurement unit, to form a sampled voltage measurement signal each increment of time, $\Delta t$, forming a voltage upper limit signal equal to a predetermined deviation greater than the average of said voltage measurement signals for all of said anode units, forming a voltage lower limit signal equal to a predetermined deviation less than the average of said voltage measurement signals for all of said anode units, comparing each of said voltage measurement signals with said voltage upper limit signal to form a voltage upper limit alarm signal whenever one of said voltage measurement signals is greater than said voltage upper limit signal and forming a voltage lower limit alarm signal whenever one of said voltage measurement signals is less than said voltage lower limit signal.

16. The method of claim 15 including the step of generating a short-indicating alarm signal whenever said current upper limit alarm signal and said voltage lower limit alarm signal are present for the same anode unit.

17. The method of claim 16 including the step of increasing the spacing between the anodes and the cathode in response to said short-indicating alarm signal.

18. The method of claim 16 including the step of closing a current bypass connection from a bus to the cathode to terminate conduction through any anode unit for which a short-indicating alarm signal has been generated.

19. A method for controlling an electrolysis reaction with apparatus including a power supply, a plurality of cells, a plurality of buses where each bus connects to each cell, a plurality of anode units in each cell where each anode unit is connected to a different bus, where the anode units in each cell are positioned in proximity to a cathode and are immersed in an electrolyte and where current is conducted from the power supply through the buses, from anode to cathode through the electrolyte, comprising sequentially for each cell the steps of, sensing the current in each of said buses to form, for each anode unit, a current measurement signal having an amplitude proportional to the current in the respective anode unit, periodically sampling for each anode unit, said current measurement signal to form a first sampled current measurement signal each increment of time, $\Delta t$, and where each first sampled current measurement signal becomes a second sampled current measurement signal after an increment of time, $\Delta t$, generating periodically each increment of time, $\Delta t$, a current change signal, $\Delta Ib$, for each anode unit, where $\Delta Ib$ is equal to the difference between the first sampled current measurement signal and the second sampled current measurement signal, comparing each current change signal, $\Delta Ib$, with a predetermined constant signal, $\epsilon$, for each anode unit, storing an accumulated measurement signal, $Xb$, for each anode unit, adding, for each anode unit, said accumulated measurement signal, $Xb$, to an incremental quantity, $Yb$, where $Yb$ varies as a function of whether said current change signal is greater than or less than said predetermined constant signal, $\epsilon$, comparing, for each anode unit said accumulated measurement signal, $Xb$, with a predetermined measurement constant to form an indication of oscillation when said accumulated measurement signal, $Xb$, exceeds said predetermined measurement constant, changing the spacing between the anodes and cathode in response to said indication of oscillation.

20. An apparatus providing alarm signals for monitoring an electrolysis reaction comprising, an electrolysis cell having a plurality of anode units, having a cathode and adapted to have an electrolyte where anode current is conducted from the plurality of anode units through the electrolyte to the cathode, means for generating a plurality of measurement signals, at least one for each of said anode units, where each of said measurement signals is proportional to an electrical parameter of a different one of said anode units, detecting means, detecting said measurement signals as current measurement signals, for detecting for each of said anode units changes in anode current with respect to time exhibiting oscillations having a frequency which is less than one cycle per second, first means for generating an oscillation alarm signal in response to detection of said oscillations by said detecting means, and second means for generating a limit alarm signal in response to one or more of said measurement signals exceeding a limit signal.

21. The apparatus of claim 20 wherein said second means includes, means for forming a current limit signal as a predetermined deviation of the average value of said current measurement signals, means for comparing each of said current measurement signals with said current limit signal to form a current alarm signal whenever one of said current measurement signals exceeds said current limit signal.

22. The apparatus of claim 20 wherein said second means includes, means for generating a plurality of voltage measurement signals, one for each of said anode units, where each of said voltage measurement signals is proportional to the voltage between a different one of said anode units and a cathode, means for comparing each of said voltage measurement signals with a voltage limit signal to provide a limit alarm signal whenever any of said voltage measurement signals exceeds said voltage limit signal.

23. The apparatus of claim 20 wherein said detecting means includes, means for generating periodically, for each anode unit, a current change signal representing the change in current over an increment of time, means for comparing said current change signal, for each anode unit, with a predetermined constant change signal, means for storing an accumulated measurement signal for each anode unit, means for incrementing or decrementing said accumulated measurement signal, for each anode unit, as a function of whether said current change signal is greater than or less than, respectively, said predetermined constant change signal, means for comparing said accumulated measurement signal, for each anode unit, with a predetermined measurement constant to form an indication that said oscillations are present when said accumulated measurement signal exceeds said predetermined measurement constant.

24. The apparatus of claim 20 including, means for increasing the spacing between said anode units and cathode in response to detection of one of said alarm signals.

25. The apparatus of claim 20 wherein said second means includes, means for forming a current upper limit signal equal to a predetermined deviation greater than the average value of said current measurement signals, means for forming a current lower limit signal equal to a predetermined deviation less than the average value of said current measurement signals, means for comparing each of said current measurement signals with said current upper limit and said current lower limit signals to form a current alarm signal whenever one of said current measurement signals is greater than said current upper limit signal or less than said current lower limit signal.

26. The apparatus of claim 20 wherein said second means includes, means for generating a plurality of voltage measurement signals, one for each of said anode units, where each of said voltage measurement signals is proportional to the voltage between a different one of said anode units and a cathode, means for forming a voltage upper limit signal equal to a predetermined deviation greater than the average of said voltage measurement signals, means for forming a voltage lower limit signal equal to a predetermined deviation less than the average of said voltage measurement signals, means for comparing each of said voltage measurement signals with said voltage upper limit signal and said voltage lower limit signal to form a voltage alarm signal whenever one of said voltage measurement signals is greater than said voltage upper limit signal or less than said voltage lower limit signal.

27. The apparatus of claim 20 wherein said second means includes, means for forming a current upper limit signal equal to a predetermined deviation greater than the average value of said current measurement signals, means for generating a plurality of voltage measurement signals, one for each of said anode units, where each of said voltage measurement signals is proportional to the voltage between a different one of said anode units and a cathode, means for forming a voltage lower limit signal equal to a predetermined deviation less than the average value of said voltage measurement signals, means for comparing each of said current measurement signals with said alarm current upper limit signal to form a current upper limit alarm signal whenever one of said current measurement signals exceeds said current upper limit signal, means for comparing each of said voltage measurement signals with said voltage lower limit signal to generate a voltage lower limit alarm signal whenever one of said voltage measurement signals is less than said voltage lower limit alarm signal, means for generating a short alarm signal whenever said current upper limit alarm signal and said voltage lower limit alarm signal are present for the same anode unit.

28. The apparatus of claim 27 including, means for increasing the spacing between said anode units cathode in response to said short alarm signal.

29. The apparatus of claim 20 including, means for controlling the spacing between said anode units and cathode in response to said current measurement signals.

30. In an electrolysis apparatus including a power supply, a plurality of buses, a plurality of anode units where each anode unit is connected to a different bus, where the anode units are positioned in proximity to a cathode and immersed in an electrolyte and where current is conducted from the power supply through the buses, from anode to cathode through the electrolyte, the apparatus for controlling an electrolysis reaction comprising, means for sensing the current in each of said buses to form, for each anode unit, a current meansurement signal having an amplitude proportional to the current in the respective anode unit, means for periodically sampling, for each anode unit, said current measurement signal to form a first sampled current measurement signal each increment of time, $\Delta t$, and where each first sampled current measurement signal becomes a second sampled current measurement signal after an increment of time, $\Delta t$, means for generating periodically each increment of time $\Delta t$ a current change signal, $\Delta Ib$, for each anode units, where $\Delta Ib$ is equal to the difference between the first sampled current measurement signal and the second sampled current measurement signal, means for comparing each current change signal, $\Delta Ib$, with a predetermined constant signal, $\epsilon$, for each anode unit, means for storing an accumulated measurement signal, Xb, for each anode unit, means for adding, for each anode unit, said accumulated measurement signal, Xb, to an incremental quantity, Yb, where Yb varies as a function of whether said current change signal is greater than or less than said predetermined constant signal, $\epsilon$, means for comparing, for each anode unit said accumulated measurement signal, Xb with a predetermined measurement constant to form an indication of oscillation when said accumulated measurement signal, Xb, exceeds said predetermined measurement constant, means for changing the spacing between the anodes and cathode in response to said indication of oscillation.

31. An apparatus for controlling a plurality of electrolysis cells where each cell includes a plurality of anode units, where anode units from different cells are connected to a plurality of current buses, and where each cell includes a cathode, the control apparatus, comprising, a plurality of cell instrumentation packages, one for each of said cells, each of said cell instrumentation packages including a plurality of current sensing means, one for each of said current buses, addressable multiplexer means for multiplexing current measurement signals from each of said current sensing means, an analog-to-digital converter for converting multiplexed current measurement signals from said multiplexer means into digital current measurement signals, transmitter and receiver means connected to said analog-to-digital converter for transmitting said digital current measurement signals as a data output, and receiver means for receiving addresses for controlling said multiplexer means, data processing means including means for generating addresses for said multiplexer means in each of said cell instrumentation packages, means for receiving and storing said digital current measurement signals at locations curresponding to said addresses, means for processing said digital current measurement signals to determine when current in any of said current buses has changes with respect to time that exhibit oscillations, means for generating an oscillation alarm whenever said oscillations are detected.

32. The apparatus of claim 31 wherein said means for generating addresses includes means for generating an address for each current measurement signal each increment of time, $\Delta t$, to form responsively a first digital current measurement signal each increment of time, $\Delta t$, and wherein said means for processing includes, first means for storing each first digital current measurement signal, second means for storing each first digital as a second digital current measurement signal and current measurement signal increment of time, $\Delta t$, after each first digital current measurement signal is stored, means for generating periodically each increment of time, $\Delta t$, a current change signal, $\Delta Ib$, for each first digital current measurement signal, where $\Delta Ib$ is equal to the difference between each first digital current measurement signal and the corresponding second digital current measurement signal, means for comparing each current change signal, $\Delta Ib$, with a predetermined constant signal, $\epsilon$, means for storing an accumulated measurement signal, $Xb$, for each current measurement signal, means for adding each said accumulated measurement signal, $Xb$, to an incremental quantity, $Yb$, where $Yb$ varies as a function of whether said current change signal is greater than or less than said predetermined constant signal, $\epsilon$, means for comparing each said accumulated measurement signal, $Xb$, with a predetermined measurement constant to form an indication of oscillation when said accumulated measurement signal, $Xb$, exceeds said predetermined measurement constant, means for changing the spacing between the anodes and cathode in any cell having said indication of oscillation.

33. The apparatus of claim 32 including means for generating said increment of time, $\Delta t$, equal to approximately 0.1 second.

34. The apparatus of claim 32 including, when the current change signal, $\Delta Ib$, is greater than $\epsilon$, means for setting said incremental quantity, $Yb$, equal to 1 and wherein when $\Delta Ib$ is less than $\epsilon$, means for setting $Yb$ equal to 0 if $Xb$ is equal to 0 and means for setting $Yb$ equal to $=1$ is $Xb$ is greater than 0.

35. The apparatus of claim 32 including means for storing said accumulated measurement signal, $Xb$, with a predetermined maximum and means for storing said constant signal, $\epsilon$, with a magnitude which is less than approximately ten per cent of said maximum.

36. The apparatus of claim 32 including, means for forming a current upper limit signal equal to a predetermined deviation greater than the average value of said current measurement signals for all of said anode units, means for forming a current lower limit signal equal to a predetermined deviation less than the average value of said current measurement signals for all of said anode units, means for comparing each of said current measurement signals with said current upper limit signal and said current lower limit signal to form a current upper limit alarm signal whenever one of said current measurement signals is greater than said current upper limit signal, and to form a current lower limit alarm signal whenever one of said current measurement signals is less than said current lower limit signal, means for sensing the voltage from anode to cathode, for each anode unit, to form a voltage measurement signal having an amplitude proportional to said voltage for each respective anode unit, means for periodically sampling said voltage measurement signal, for each measuremtn unit, to form a sampled voltage measurement signal each increment to time, $\Delta t$, means for forming a voltage upper limit signal equal to a predetermined deviation greter than the average of said voltage measurement signals for all of said anode units, means for forming a voltage lower limit signal equal to a predetermined deviation less than the average o said voltage measurement signals for all of said anode units, means for comparing each of said voltage measurement signals with said voltage upper limit signal to forrm a voltage upper limit alarm signal whenever one of said voltage measurement signals is greater than said voltage upper limit signal and forming a voltage lower limit alarm signal whenever one of said voltage measurement signals is less than said voltage lower limit signal.

37. The apparatus of claim 32 including, means for generating a short-indicating alarm signal whenever said current upper limit alarm signal and said voltage lower limit alarm signal are present for the same anode unit.

38. The apparatus of claim 32 including, means for increasing the spacing between the anodes and the cathode in response to said short-indicating alarm signal.

39. The apparatus of claim 32 including, means for closing a current bypass connection from a bus to the cathode to terminate conduction through any anode unit for which a short-indicating alarm signal has been generated.

* * * * *

UNITED STATES PATENT AND TRADEMARK OFFICE

CERTIFICATE OF CORRECTION

PATENT NO. : 4,069,118

DATED : January 17, 1978

INVENTOR(S) : Hixson, et al

It is certified that error appears in the above-identified patent and that said Letters Patent are hereby corrected as shown below:

Claim 6, column 20, line 51, between "to" and "a", delete "from" and substitute therefor--form--.

Claim 10, column 21, line 24, after "where the", delete "andoe" and substitute therefor-anode--.

Claim 27, column 25, line 28, between "said" and "current", delete "alarm".

Claim 28, column 25, line 44, between "units" and "cathode", insert--and--.

Claim 31, column 26, line 51, between "locations" and "to", delete "curresponding" and substitute therefor--corresponding--.

Claim 34, column 27, line 34, between "to" and "is", delete "=1" and substitute therefor-- -1 --.

UNITED STATES PATENT AND TRADEMARK OFFICE

CERTIFICATE OF CORRECTION

PATENT NO. : 4,069,118

DATED : January 17, 1978

INVENTOR(S) : Hixson, et al

It is certified that error appears in the above-identified patent and that said Letters Patent are hereby corrected as shown below:

Claim 36, column 28, line 16, between "each" and "unit", delete "measuremtn" and substitute therefor--measurement-.

Claim 36, column 28, line 19, between "deviation" and "than", delete "greter" and substitute therefor--greater--.

Claim 36, column 28, line 24, before "said voltage", delete "o" and substitute therefor--of--.

Claim 36, column 28, line 28, before "a voltage", delete "forrm" and substitute therefor--form--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*